US007367455B2

(12) United States Patent
Maffei

(10) Patent No.: US 7,367,455 B2
(45) **Date of Patent: *May 6, 2008**

(54) BOX FOR GLASS VIALS WITH AN ENSEMBLE OF TOOLS FOR FACILITATING BREAKING OF THE NECKS OF THE VIALS

(75) Inventor: Camilla Maffei, Pistoia (IT)

(73) Assignee: PROJECT S.a.s. di Massimo Memichelli & C, Pistola (IT)

( * ) Notice: Subject to any disclaimer, the term of this patent is extended or adjusted under 35 U.S.C. 154(b) by 454 days.

This patent is subject to a terminal disclaimer.

(21) Appl. No.: 11/002,758

(22) Filed: Dec. 2, 2004

(65) Prior Publication Data

US 2005/0126949 A1 Jun. 16, 2005

(30) Foreign Application Priority Data

Dec. 5, 2003 (IT) ..... FI2003A0313

(51) Int. Cl.
*B65D 85/42* (2006.01)
*B26F 3/00* (2006.01)

(52) U.S. Cl. ..... 206/528; 206/443; 225/97

(58) Field of Classification Search ..... 206/528–540, 206/443; 225/93–106; 241/99
See application file for complete search history.

(56) References Cited

U.S. PATENT DOCUMENTS 3,115,247 A * 12/1963 Hauser ..... 206/528
3,640,437 A * 2/1972 Galy ..... 225/96.5
4,159,568 A * 7/1979 Berner ..... 206/528
4,405,067 A * 9/1983 Caron ..... 225/93
5,871,145 A * 2/1999 Hermann et al. ..... 206/443
7,028,839 B2 * 4/2006 Belloli et al. ..... 206/443
2006/0112571 A1 * 6/2006 Maffei ..... 30/400

FOREIGN PATENT DOCUMENTS

| | | | |
|---|---|---|---|
| EP | 1 538 109 | A1 | 6/2005 |
| FR | 2550170 | A1 * | 2/1985 |
| FR | 2703336 | A1 * | 10/1994 |
| IT | FI2002/A/000159 | | 8/2002 |
| WO | PCT/IT03/00494 | | 8/2003 |

* cited by examiner

*Primary Examiner*—Bryon P Gehman
(74) *Attorney, Agent, or Firm*—McGlew and Tuttle P.C.

(57) ABSTRACT

A dinked card (53, 51, 57, 53, 64) that forms a box is equipped with an appendage (78) constituting an ensemble of strip (80), each with a central hole (80A), which are individually detachable from the appendage; the appendage (78) is detachable from inside the box formed, and can be kept in the box itself after a strip has been taken out to be used when required.

16 Claims, 19 Drawing Sheets

Fig.3
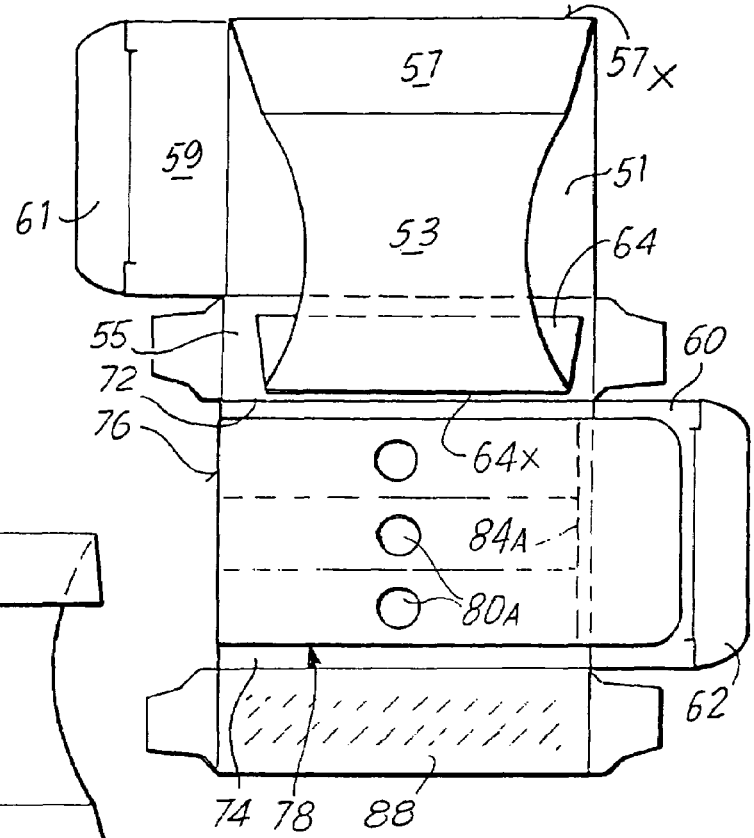
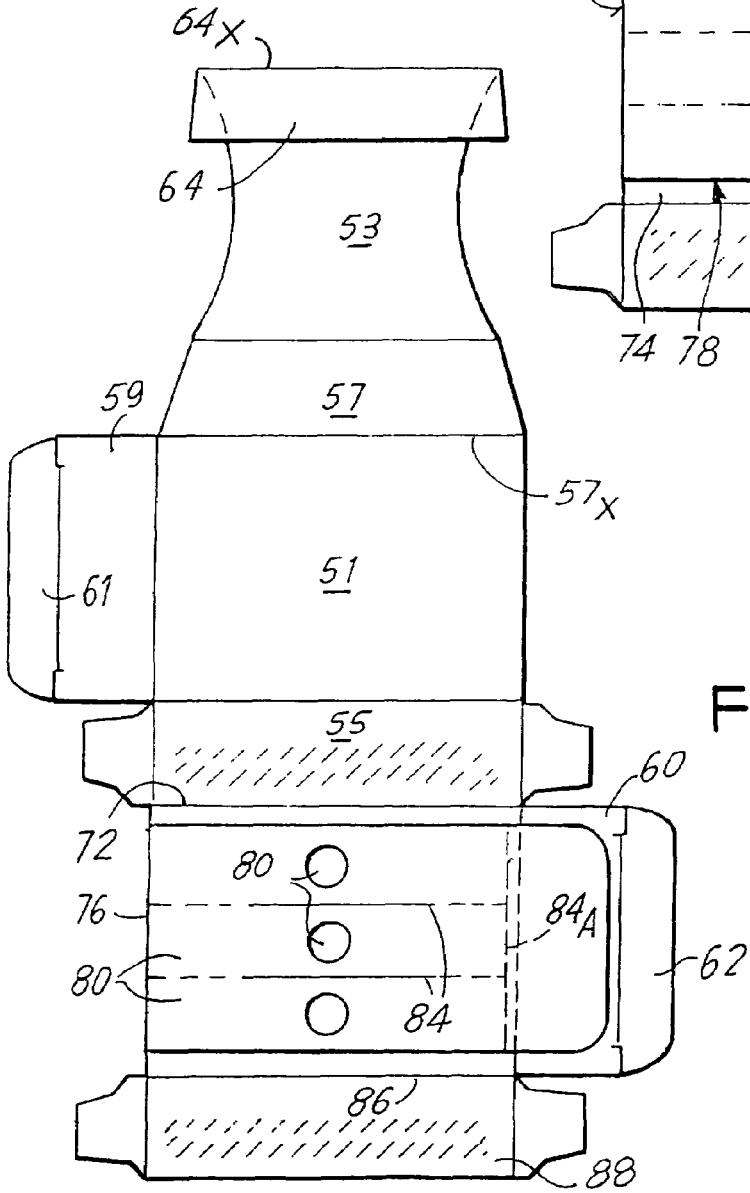
Fig.2

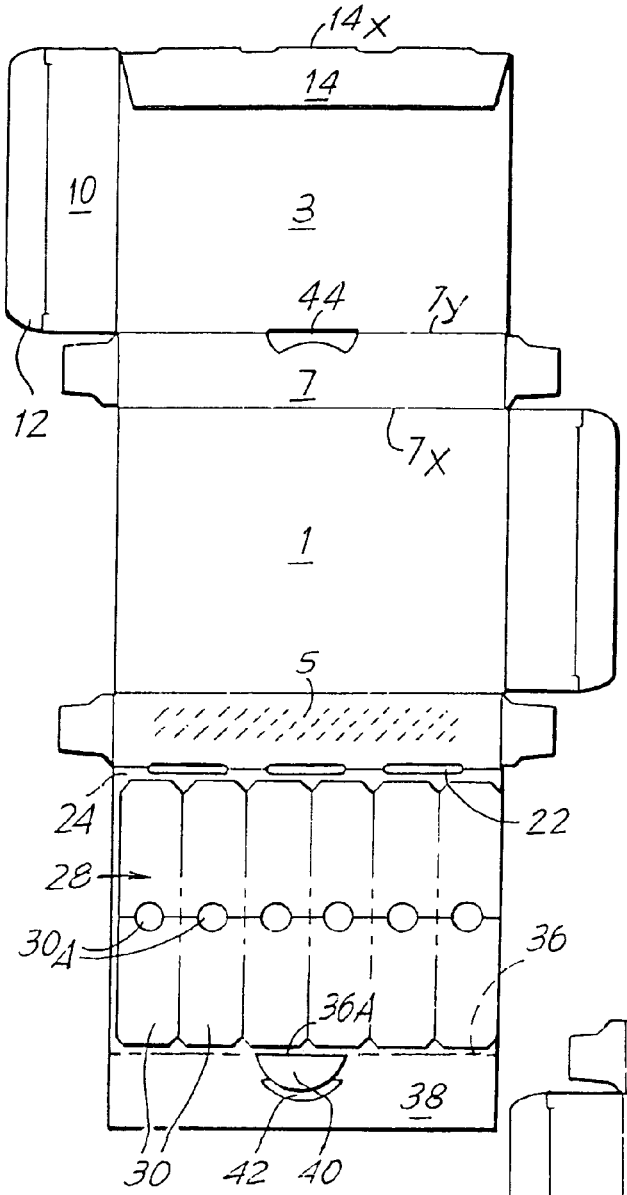
Fig.20
Fig.21
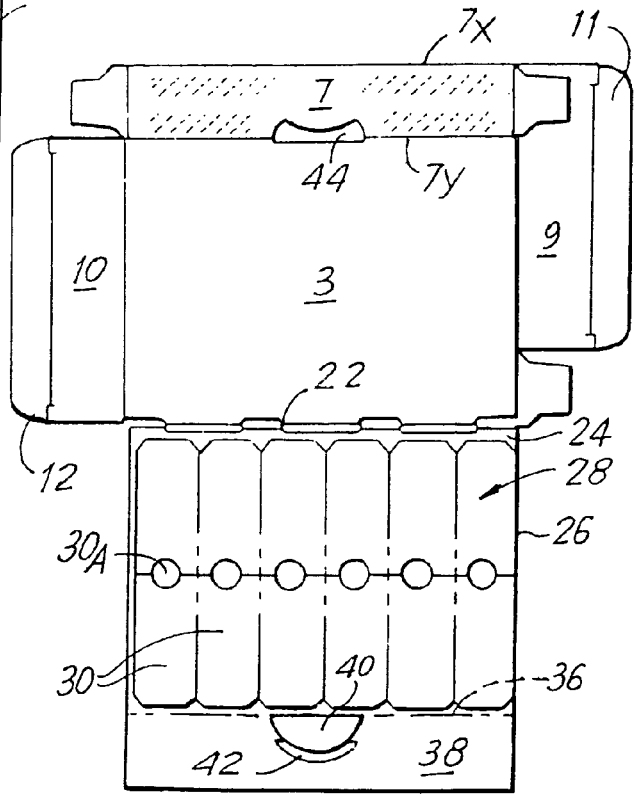

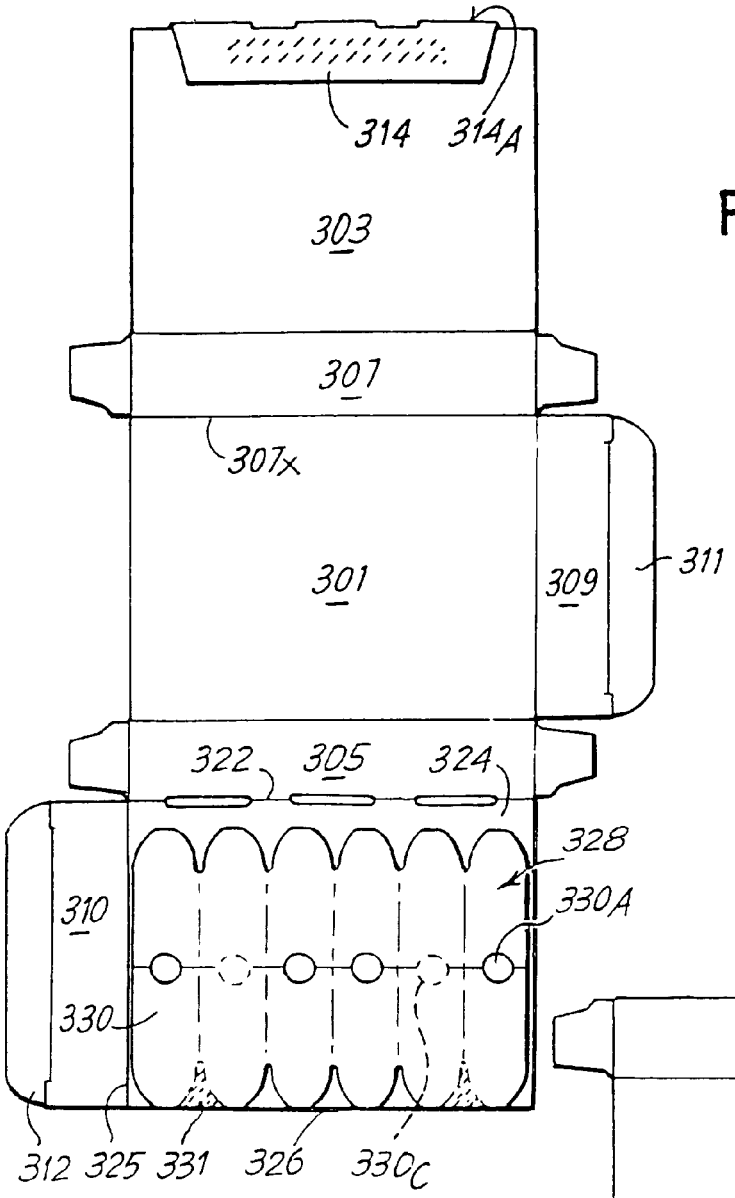
Fig.27
Fig.28
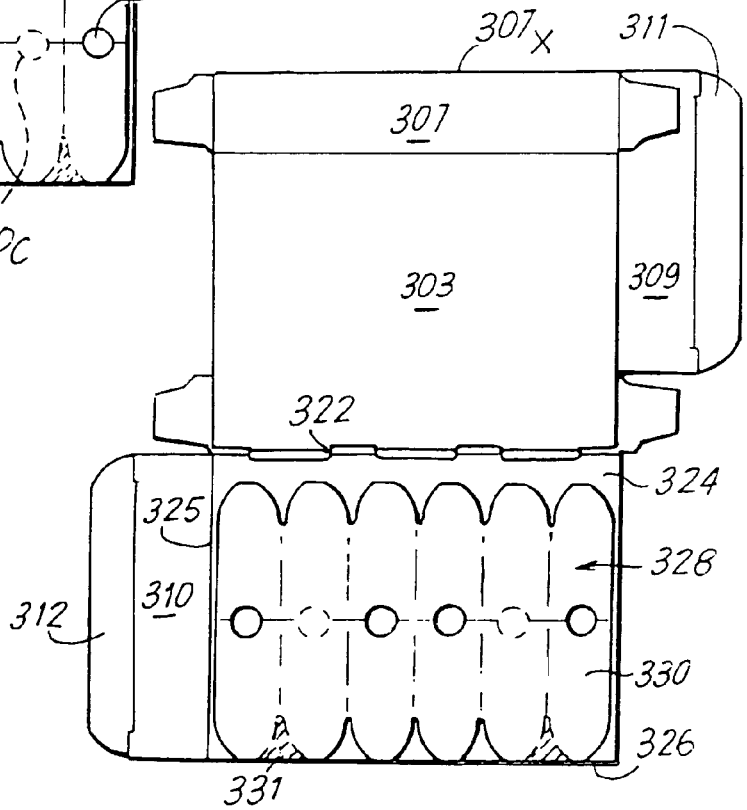

Fig. 29
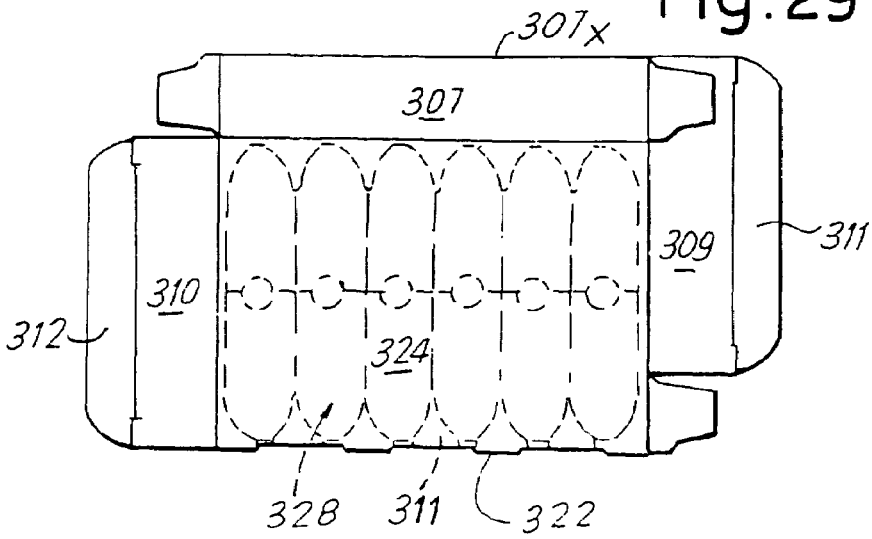
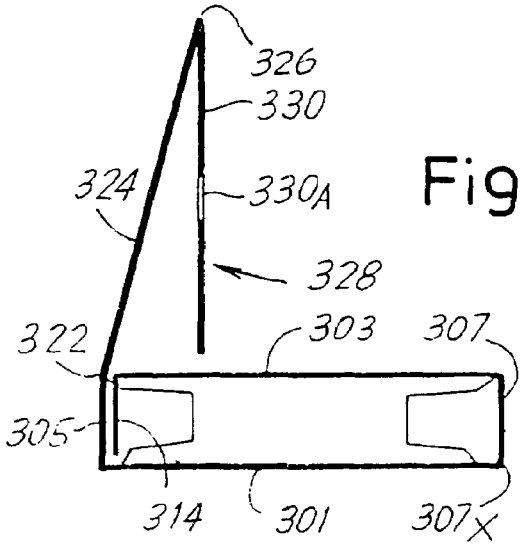
Fig. 30
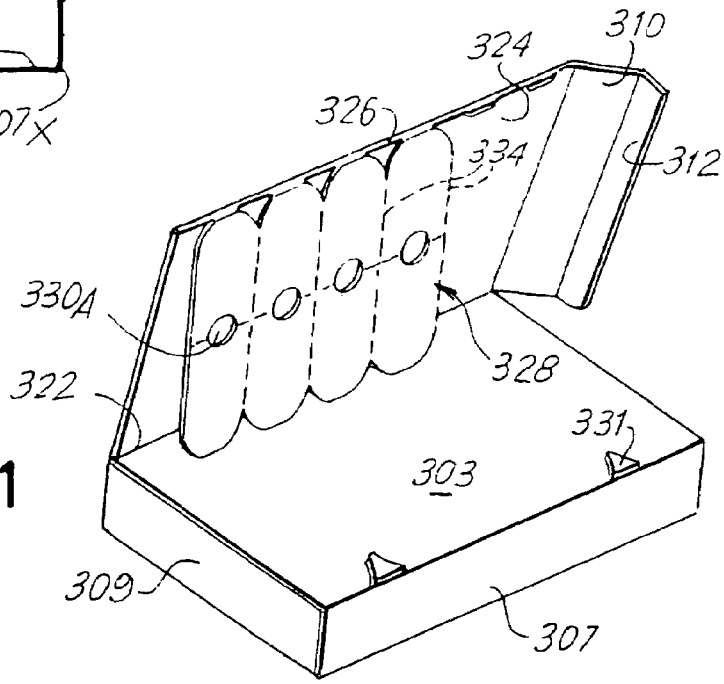
Fig. 31

Fig. 36
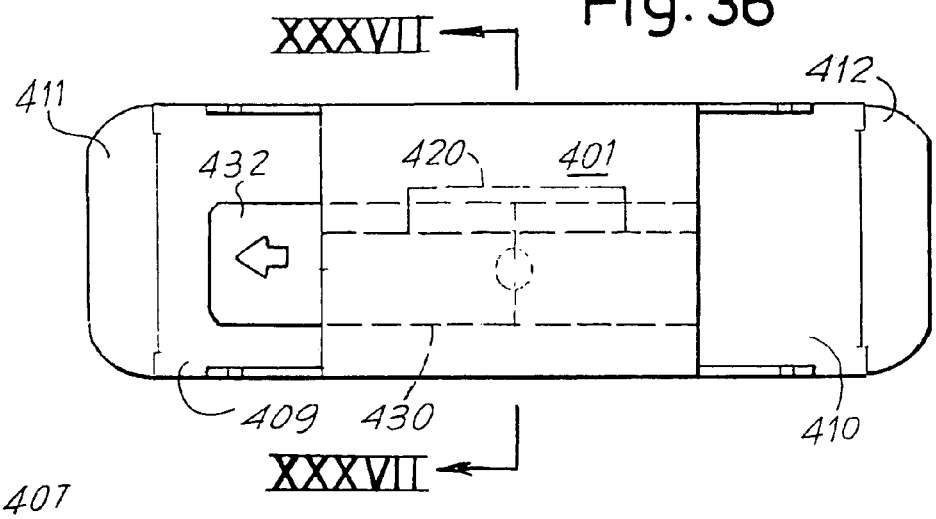
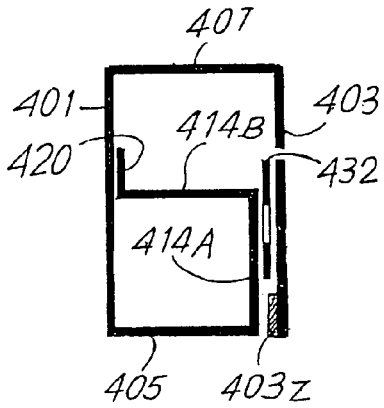
Fig. 37
Fig. 38
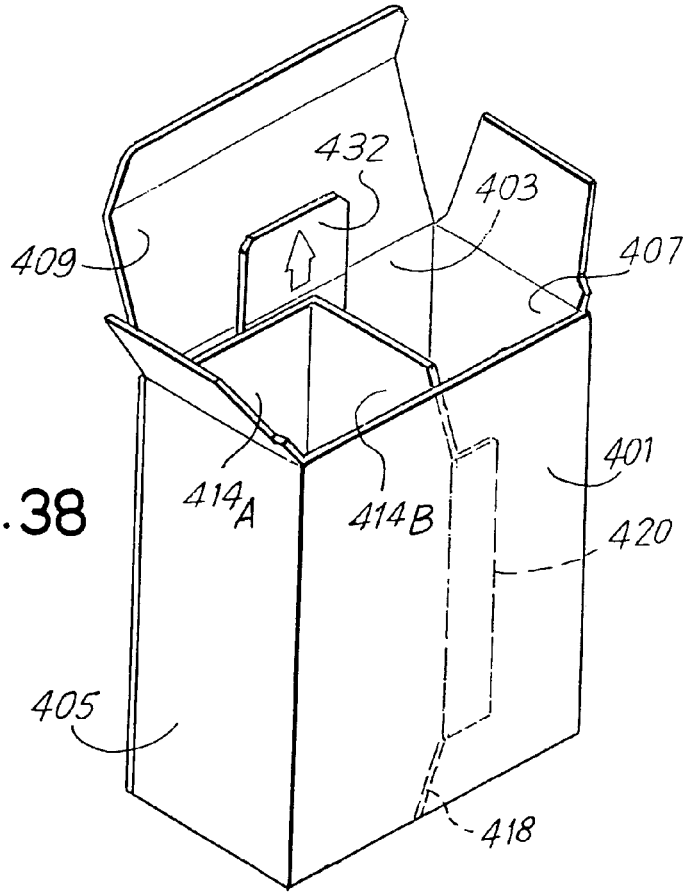

BOX FOR GLASS VIALS WITH AN ENSEMBLE OF TOOLS FOR FACILITATING BREAKING OF THE NECKS OF THE VIALS

Co-pending Italian patent application N° FI2002/A/000159 dated Aug. 21, 2002 (and International application PCT/IT03/00494, publication n. WO-A-2004/018344) relates to a tool for facilitating breaking of the neck of a glass vial for medicines or the like and designed to protect the operator from injuring his fingers, said tool being obtained from a strip of card with a hole located in an intermediate position and an invitation for transverse folding. The co-pending application also comprises an ensemble of said strip-like tools, one of which can be detached for being used either just once or a number of times for breaking the neck of a vial. Furthermore, the co-pending application comprises a box for containing a glass vial with a neck to be broken off, which also comprises an appendage that stems from one of the portions forming the box, said appendage constituting an ensemble of strip-like tools, which can be detached individually from pre-cutting lines and are made as indicated above.

The present invention relates to a box of the type referred to above that is improved as compared to the one provided in the co-pending application, for purposes that will emerge clearly, for persons operating in the sector, from the ensuing text, both as regards production of the box and as regards use of what is combined with the box itself.

Basically, in the box for a glass vial with a neck to be broken off—which is obtained from a dinked card that forms the box and with an appendage constituting an ensemble of strip-like tools, each with a central hole, which can be individually detached from the appendage itself—according to the invention said appendage can be detached from inside the formed box and can be kept in the box itself after a strip-like tool to be used when required has been taken out. The appendage can be kept in the box or else can be kept in a pouch-like seat formed by one of the fronts and by a portion that is engaged with a flap to one side of the box. Said appendage can develop from said portion and can be detached therefrom.

In any case, said appendage is connected to the dinked card by a folding and pre-cutting line that can be partialized by cut areas to facilitate detachment. Alternatively, said appendage can be connected to the dinked card by a bridge connected to a portion of the material of one of the fronts, said portion being detachable from said front to enable manoeuvre of detachment of the appendage.

In a variant embodiment, the box comprises a prolongation of the dinked card, which develops from an edge of one of the two fronts and may be turned down and withheld against said front. Developing from said prolongation is an area that is withheld between said front and said prolongation and comprises a plurality of detachable strips with a central hole for constituting a tool for breaking off the neck of the glass vial.

The prolongation of the dinked card may have a tab designed to withhold said prolongation against the front from which it stems, or else from the prolongation there may develop one of the closing flaps of the box, said closing flap withholding said prolongation against the front as long as the flap remains in the configuration of closing of the box.

A fuller understanding of the invention emerges from the ensuing description and the attached plate of drawings, which provides a practical non-limiting example of the invention itself. In the plate of drawings:

FIGS. 1 to 6 show the development of the dinked card according to a first embodiment in a view showing the internal face (FIG. 1), in three successive steps of formation (FIGS. 2, 3, 4), in a perspective view of the open box (FIG. 5), and in a cross-sectional view taken along VI-VI of FIG. 5 (FIG. 6);

FIGS. 19 to 25 show a development of the dinked card according to a variant embodiment in a view showing the internal face (FIG. 19), in three successive steps of formation (FIGS. 20, 21, 22), in a cross-sectional view taken along XXIII-XXIII of FIG. 22 (FIG. 23), in a semi-open perspective view (FIG. 24), and in a cross-sectional view taken along XXV-XXV of FIG. 24 (FIG. 25);

FIGS. 26 to 31 show a development of the dinked card according to a second variant embodiment in a view showing the internal face (FIG. 26), in three successive steps of formation (FIGS. 27, 28, 29), in a cross-sectional view taken along XXX-XXX of FIG. 29 (FIG. 30), and in a semi-open perspective view (FIG. 31); and FIGS. 32 to 38 show the development of the dinked card according to an embodiment of a box with two compartments, for a flask and a vial of solvent or the like, in a view showing the internal face (FIG. 32), in four successive steps of formation, in a cross-sectional view taken along XXXVII-XXXVII of FIG. 36, and in a semi-open perspective view.

Figure 1:
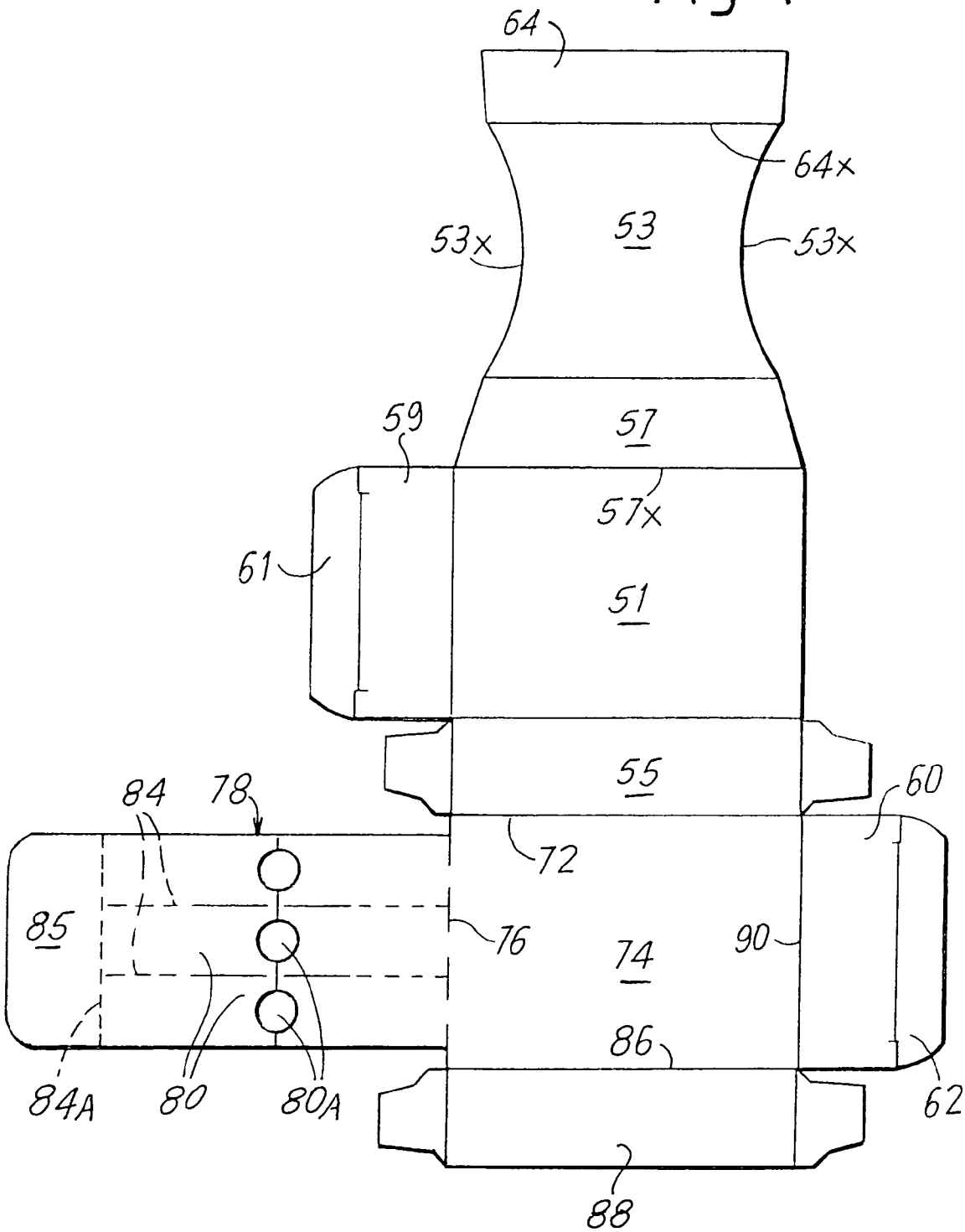
Figure 4:
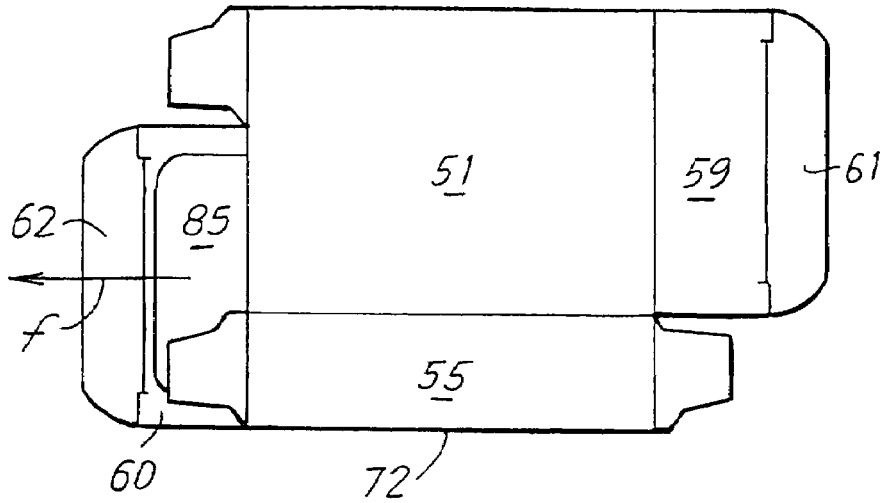
Figure 6:
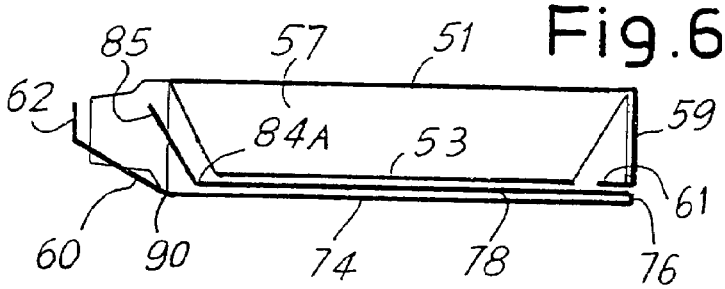
Figure 5:
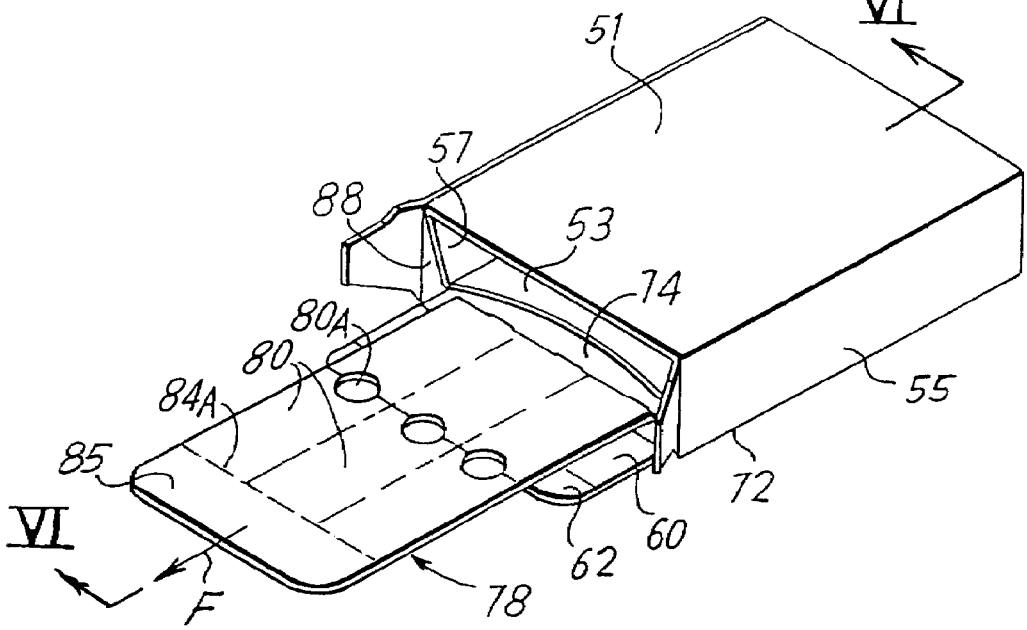

FIGS. 1 to 6 show a solution with a single dinked element, as illustrated—from the internal face of the finished box—in FIG. 1; this dinked element forms the box and an ensemble of breaking-off tools.

The box is made up of two fronts 51 and 53 and two sides 55 and 57. A closing flap 59 with a closing tab 61 stems from the front 51, whilst the other closing flap 60 with a closing tab 62 stems from a prolongation that is to be described hereinafter. An appendage 64, stemming from the front 53, is glued on the inside of the side 55 to complete the box, access to which for filling may be obtained by lifting one or the other of the closing flaps 59 and 60. The front 53 has the sides 53X with a concave profile, which prolongs also onto the contiguous parts 57 and 64.

The box thus obtained is completed by a prolongation of the dinked card beyond the folding line 72 which defines the side 55. This prolongation comprises an area 74 of development that is practically equivalent to that of the front 51. Said area 74 is delimited by a folding and pre-cutting line 76, from which there develops a lateral area 78 having a morphology constituted by a plurality of strips 80 which can be separated to function as breaking-off tools, each one of which has a hole 80A, as described in the aforementioned co-pending application. In greater detail, the area 78 beyond the folding and pre-cutting line 76 has a certain number (three in the drawings) of strips 80 orthogonal to the folding and pre-cutting line 76 and delimited by pre-cutting lines 84, which develop from the line 76 as far as a folding and pre-cutting line 84A, which delimits a terminal tab 85.

Consequently, the individual strips 80 can progressively be detached since they can be separated along the pre-cutting lines 76, 84 and 84A. Each of the strips 80 has the hole 80A and a transverse folding line in a position corresponding to the hole 80A, to constitute a breaking-off device altogether equivalent to the ones previously described in the aforesaid co-pending application.

The area 74 is further delimited by a folding line 86. Extending beyond said line 86 is a flap 88, which is designed to be glued on the inside of the side 57. Furthermore, the area 74 is delimited by a folding line 90 (opposite to the folding line 76), from which there prolongs the closing flap 60 with the corresponding tab 62.

In order to form the box, in the first place the area 78 is turned down about the folding and pre-cutting line 76 on the internal face of the area 74 (FIGS. 1 and 2), and the appendage 64 is turned down about the folding line 64X on the front 53. Then the internal face of the side 55 is moistened with glue and the ensemble of the parts 57, 53 and 64 is turned down about the folding line 57X (see FIGS. 2 and 3) on the front 51, so that the appendage 64 (being folded) with its external face is glued onto the internal face of the side 55 (FIG. 3). Then (FIGS. 3 and 4), the external face of the side 57 (or the flap 88) is moistened with glue and the ensemble 78, 74, 88 is turned down about the folding line 72 against the front 53 and the side 57 for gluing (FIG. 4) the internal face of the flap 88 against the external face of the side 57.

In this way there is created the flattened box formed by: the front 51; the side 55 coupled to the appendage 64; the front 53; and the side 57 coupled to the flap 88. The area 74 is set alongside the front 53 with interposition of the area 78 of the strips 80; there is thus created an envelope that houses the area 78. The box is completed by the closing flaps 59 and 60. The box can be deformed into the three-dimensional configuration in a conventional way to cause it to assume the configuration illustrated in FIGS. 5 and 6. The area 78 remains in the box with the terminal tab 85 slightly folded in an area adjacent to the flap 50.

When the box is first used, the closing flap 60, 62 is opened. It is thus possible to grip the terminal tab 85. By exerting a tensile force indicated by the arrow f (FIG. 6), there is obtained detachment of the ensemble 78 of the strips 80, which can be extracted from the pocket defined between the two areas 53 and 74 to enable one of the strips to be taken. To facilitate detachment of the element 78 along the pre-cutting line 76, this will be partialized and completed by totally cut stretches. The element 78 can be kept in the box and taken out whenever a strip 80 is to be used.

Traditional paper techniques readily enable mechanized production.

Figure 7:
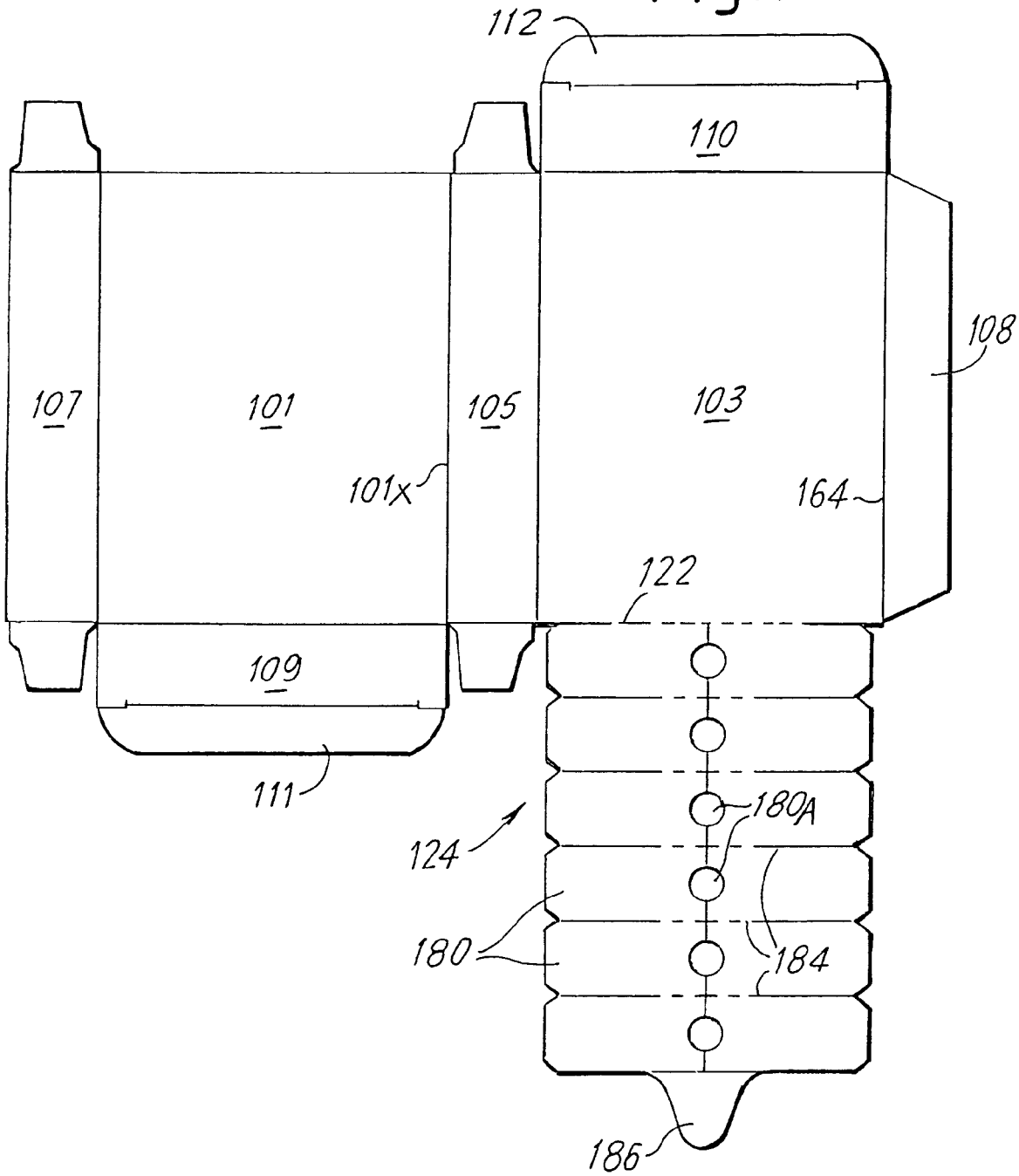
FIGS. 7 to 12 show the development of the dinked card according to a second embodiment in a view showing the internal face (FIG. 7), in three successive steps of formation (FIGS. 8, 9, 10), in a cross-sectional view taken along XI-XI of FIG. 10 (FIG. 11), and in a perspective view of the open box and with parts removed (FIG. 12)
Figure 8:
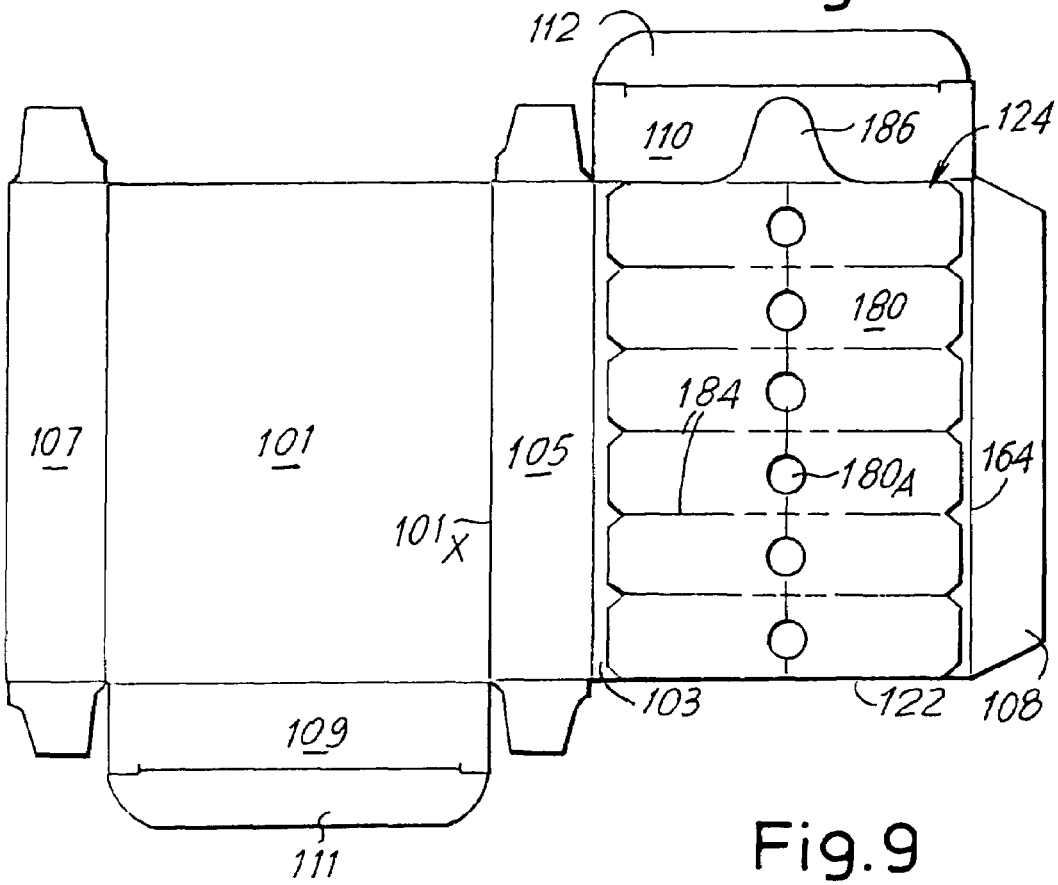

FIGS. 7 to 12 show a solution with a single dinked element, as illustrated from the internal face of the finished box in FIG. 7. Said dinked element forms the box and an ensemble of breaking-off tools.

The box is constituted by the two fronts 101 and 103 and by the two sides 105 and 107. One closing flap 109 with the closing tab 111 stems from the front 101, whilst the other closing flap 110 with a closing tab 112 stems from the front 103. An appendage 108, stemming from the front 103, is glued on the inside of the side 107 for completing the box, access to which for filling can be gained by lifting up one or the other of the closing flaps 109 and 110.

The box thus made is completed by a prolongation of the dinked card beyond a folding and pre-cutting line 122, which defines the front 103. This prolongation is constituted by an area 124 having a development approximately equivalent to that of the fronts 101 and 103. Said area 124 has a morphology made up of a plurality of strips 180, which are parallel to the folding and pre-cutting line 122 and can be separated from one another to function as breaking-off tools, each with a hole 80A, as described in the aforesaid co-pending application. In greater detail, the area 124 beyond the folding and pre-cutting line 122 has a certain number (six in the drawing) of strips 180 parallel to the folding and pre-cutting line 122 and delimited by pre-cutting lines 184. Consequently, individual strips 180 can be progressively detached since they can be separated along the pre-cutting lines 184. Each of the strips 180 has a hole 180A and a transverse folding line in an area corresponding to the hole 180A, to constitute a breaking-off device altogether equivalent to the ones previously described in the aforesaid co-pending application. The area 124 terminates with a tab 186.

Figure 9:
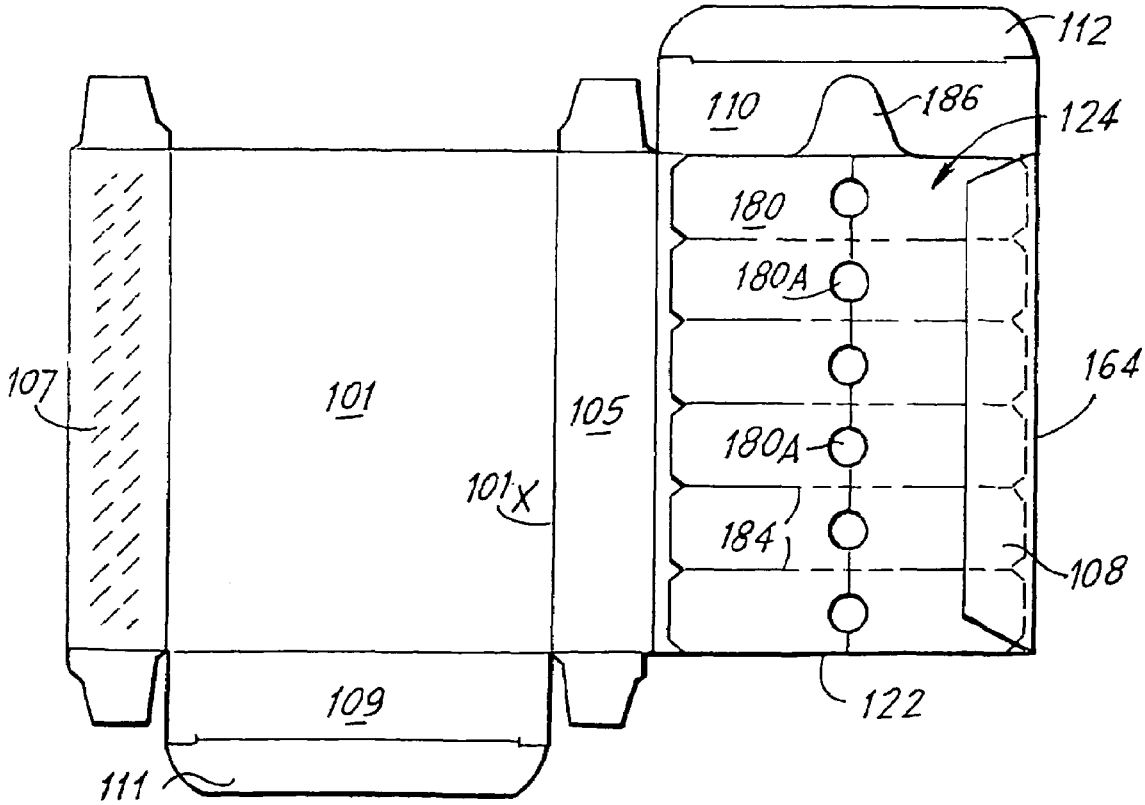
Figure 10:
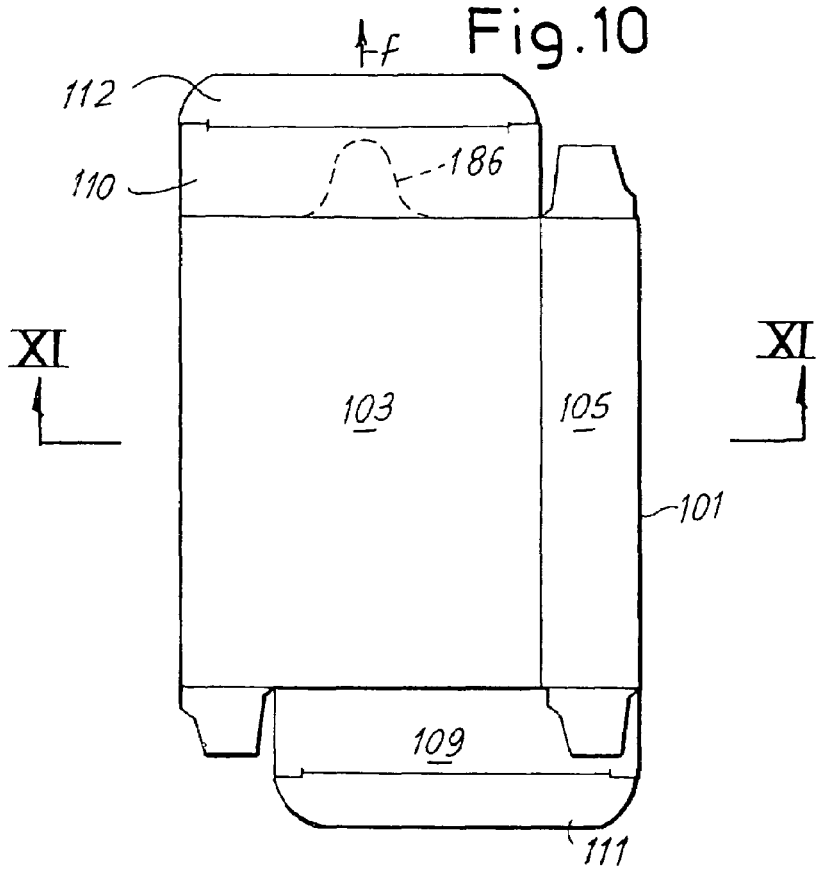
Figure 11:
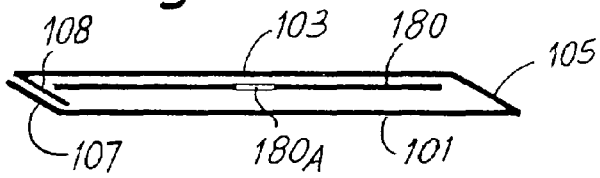
Figure 12:
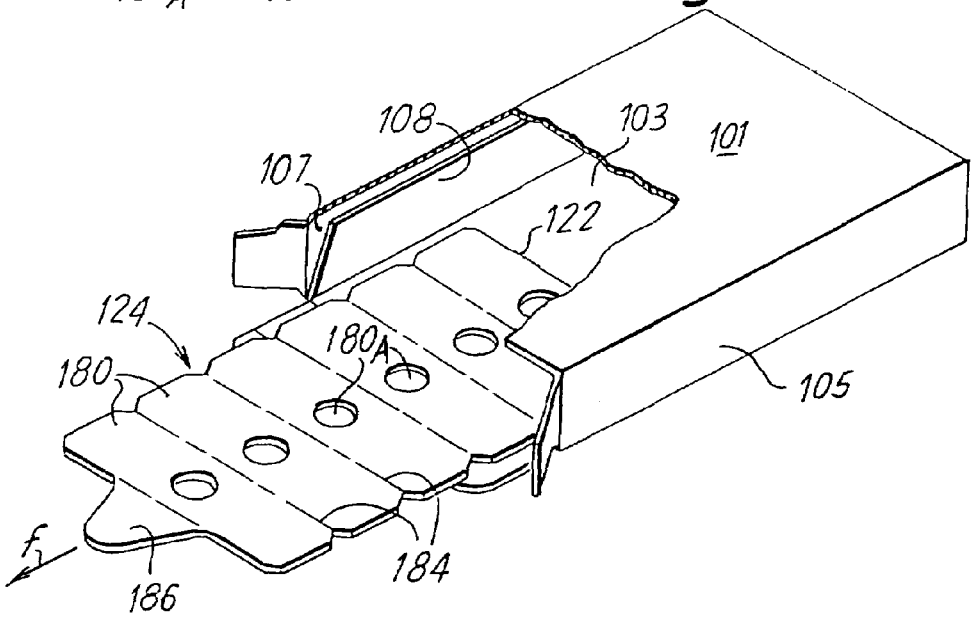

For forming the box, in the first place the area 124 is turned down about the folding and pre-cutting line 122 on the front 103 (FIGS. 7 and 8) and (FIGS. 8 and 9) the appendage 108 is turned down about the folding line 164 on the area 124, which in turn is turned down on the front 103. Then the internal face of the side 107 (or the appendage 108) is moistened with glue, and the ensemble of the parts 101, 107 is turned down about the folding line 101X (FIGS. 9 and 10). The appendage 108 is thus glued on the internal face of the side 107. It is also possible to carry out this operation in any other equivalent way.

In this way, there is obtained the flattened box formed by: the front 101; the side 107 coupled to the appendage 108; the front 103; and the side 107. The box is completed by the closing flaps 109 and 110. On the inside of the flattened box there is the area 124 with the strips 180. The box can be deformed into the three-dimensional configuration in a conventional way to bestow thereon the configuration illustrated in FIG. 12.

When the box is first used, the closing flap 110 is opened. It is thus possible to grip the terminal tab 186 of the area 124 of the strips 180. By exerting a tensile force indicated by the arrow f (FIG. 12) there is caused detachment of the ensemble 124 of the strips 180, which can be extracted from the box for taking one of the strips. In order to obtain detachment of the element 124 along the pre-cutting line 122, this will be partialized and completed by totally cut stretches. The element 124 can be kept in the box and extracted therefrom whenever a strip 180 is to be taken.

Traditional paper techniques readily enable mechanized production.

Figure 13:
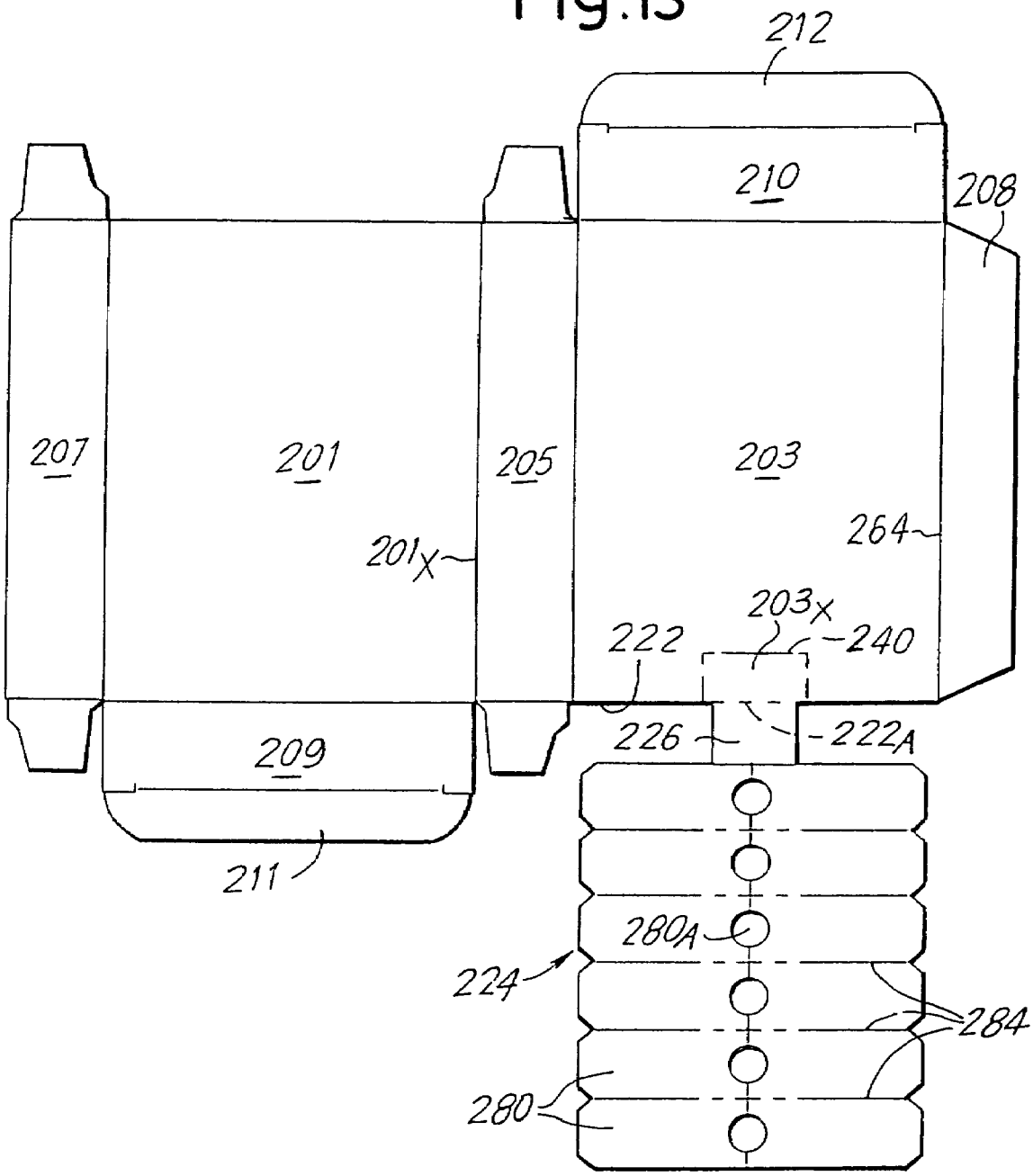
FIGS. 13 to 18 show the development of the dinked card according to a third embodiment in a view showing the internal face (FIG. 13), in three successive steps of formation (FIGS. 14, 15 and 16), in a partially sectioned longitudinal view (FIG. 17) for start of the step of detachment of the ensemble of the breaking-off tools, and in an open perspective view (FIG. 18)
Figure 14:
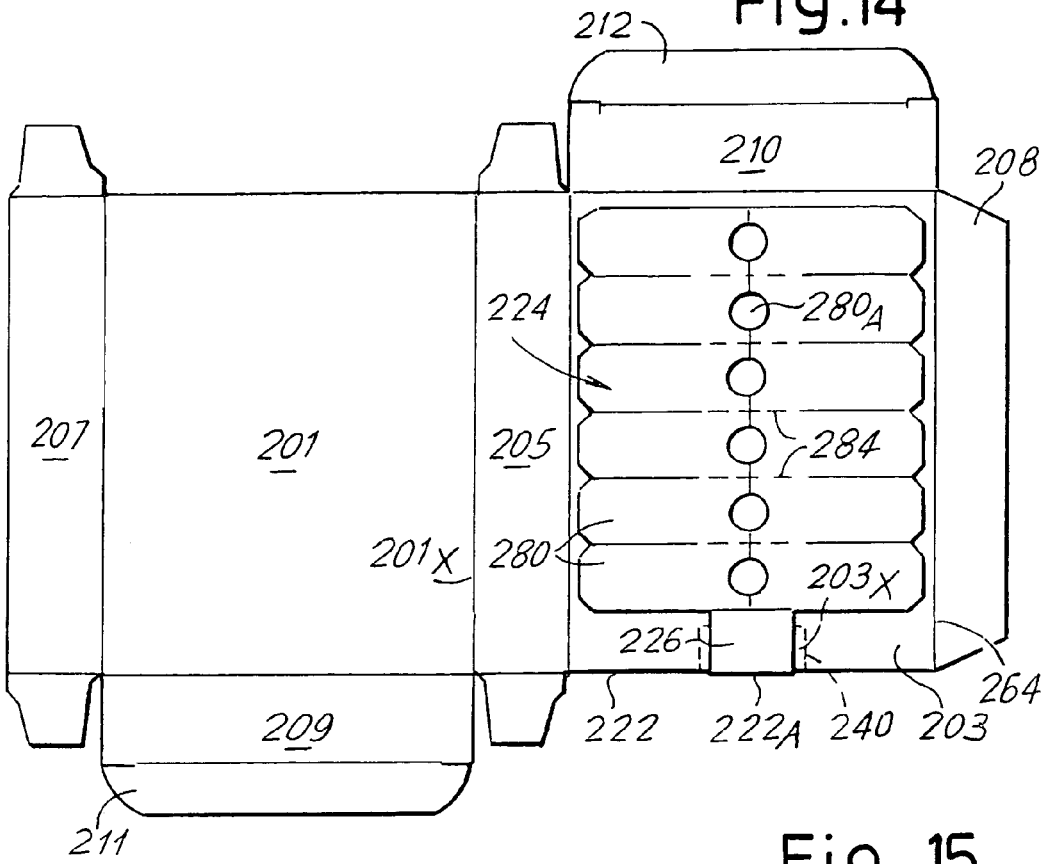
Figure 15:
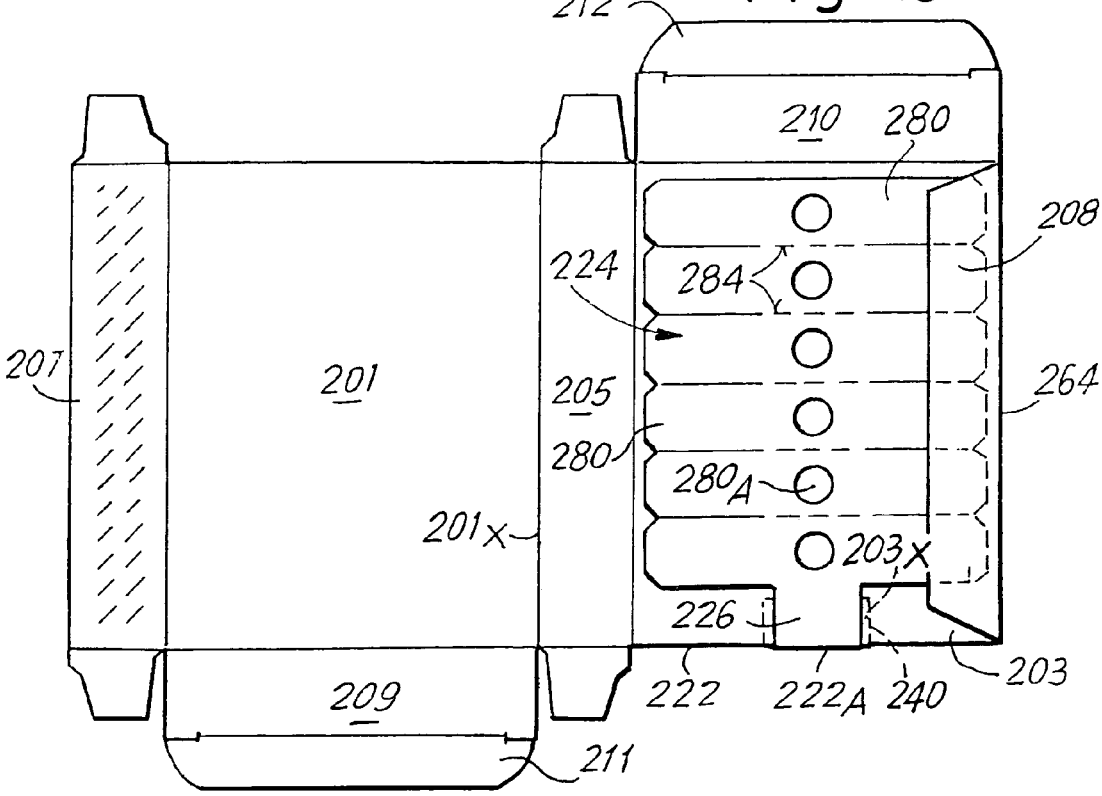

FIGS. 13 to 18 show a solution with a single dinked element, as shown from the internal face of the finished box in FIG. 13; this dinked element provides the box and an ensemble of breaking-off tools.

The box is formed by the two fronts 201 and 203 and by the two sides 205 and 207. One closing flap 209 with a closing tab 211 stems from the front 201, whilst the other closing flap with a closing tab 212 stems from the front 203. An appendage 208, stemming from the front 203, is glued on the inside of the side 207 to complete the box, access to which for filling can be gained by lifting up one or the other of the closing flaps 209 and 210.

The box thus made is completed by a prolongation of the dinked card beyond an edge 222, which defines the front 203. This prolongation is formed by an area 224 radiused by a bridge 226 to the edge 222 and has a development approximately equivalent to that of the fronts 201 and 203. Said area 224 has a morphology made up of a plurality of strips 280, which are parallel to the edge 222 and can be separated from one another so as to function as breaking-off tools, each with a hole 280A, as described in the aforesaid co-pending application. In greater detail, the area 124 beyond the folding and pre-cutting line 122 has a certain number (six in the drawing) of strips 180 parallel to the edge 222 and delimited by pre-cutting lines 284. Consequently, individual strips 280 can be progressively detached since they can be separated along the pre-cutting lines 284. Each of the strips 280 has the hole 280A and a transverse folding line in an area corresponding to the hole 280A so as to form a breaking-off device altogether equivalent to the ones previously described in the aforesaid co-pending application. The bridge 226 stems from the central area of the edge 222, in an area corresponding to a portion 203X of the front 203, which is delimited by a pre-cutting line 240 having a rectangular shape or any other shape and is completed by a folding line 222A aligned to the edge 222.

Figure 16:
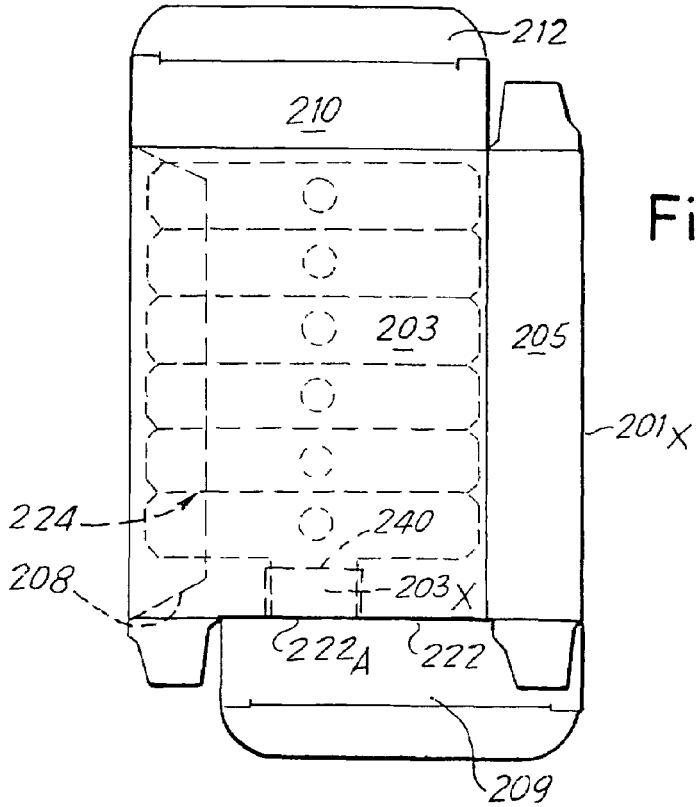
Figure 17:
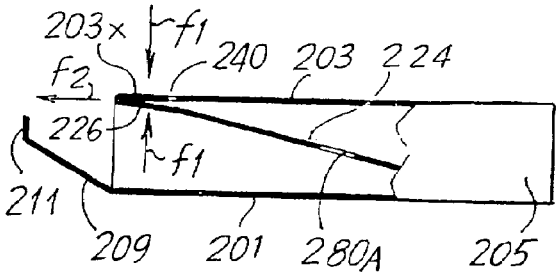

In order to form the box, in the first place the area 224 is turned down about the folding line 222A on the front 203 (FIG. 14), and (FIG. 15) the appendage 208 is turned down about the folding line 264 on the area 224, which in turn is turned down on the front 203. Then the internal face of the side 207 or the appendage 208 is moistened with glue, and the ensemble of the parts 201, 207 is turned down about the folding line 201X (FIGS. 16 and 17). Thus the appendage 208 is glued on the internal face of the side 203.

In this way, there is obtained the flattened box formed by: the front 201; the side 207 coupled to the appendage 208; the front 203; and the side 205. The box is completed by the closing flaps 209 and 210. On the inside of the flattened box there is the area 224 with the strips 280. The box can be deformed into the three-dimensional configuration in a conventional way so as to bestow thereon the configuration illustrated in FIGS. 17 and 18.

Figure 18:
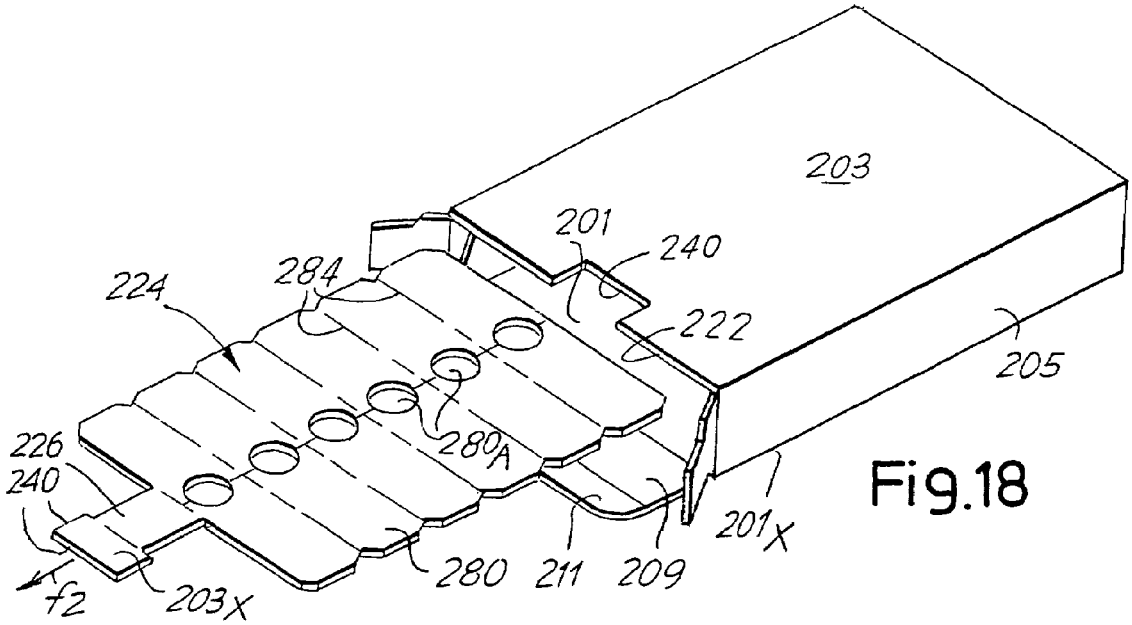
Figure 19:
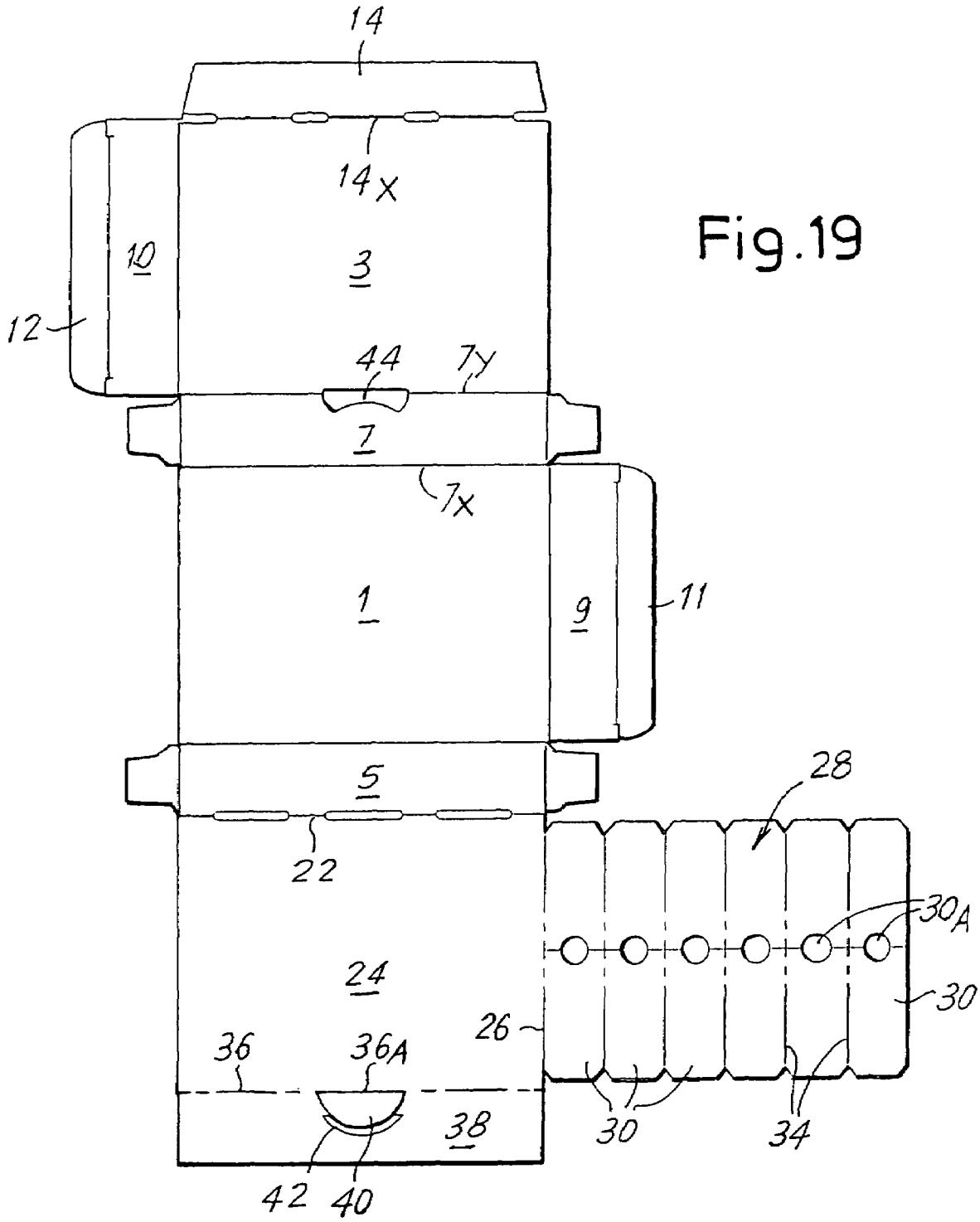
Figure 23:
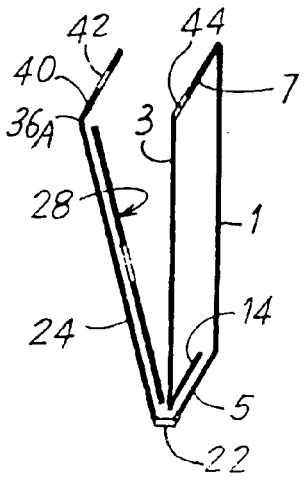

When the box is first used, the closing flap 209 is opened and it is thus possible to grip easily, as indicated by the arrows f1 of FIG. 17, the portion 203X of the material of the front 203 and the bridge 226 set alongside it, and it is thus possible to detach from the front 203 said portion 203X by acting with a tensile force in the direction indicated by the arrow f2 of FIGS. 17 and 18. It is thus possible to take out the element 224 and detach a first one of the strips 280. The residual portion of the element 224 can be reinserted in the box to be re-extracted whenever a further strip-like tool 280 is required.

FIGS. 19 to 25 show a solution with a single dinked element, as shown from the internal face of the finished box in FIG. 1; this dinked element provides the box and an ensemble of breaking-off tools.

The box is formed by the two fronts 1 and 3 and by the two sides 5 and 7. One closing flap 9 with a closing tab 11 stems from the front 1, whilst the other closing flap 10 stems from the front 3 and is prolonged with the closing tab 12. An appendage 14, stemming from the front 3, is glued on the inside of the side 5 to complete the box, access to which for filling can be obtained by lifting up one or the other of the closing flaps 9 and 10.

The box thus made is completed by a prolongation of the dinked card beyond the folding line 22 that defines the side 5. This prolongation comprises an area 24 of development approximately equivalent to that of the fronts 1 and 3. Said area 24 is delimited by a folding and pre-cutting line 26, from which there develops an area 28 having a morphology made up of a plurality of strips 30 that can be separated so as to function as breaking-off tools, each with a hole 30A, as described in the aforesaid co-pending application. In greater detail, the area 28 beyond the folding and pre-cutting line 26 has a certain number (six in the drawing) of strips 30 parallel to the folding and pre-cutting line 26 and delimited by pre-cutting lines 34, so that individual strips 30 can be progressively detached since they can be separated along the pre-cutting lines 34. Each of the strips 30 has the hole 30A and a transverse folding line in an area corresponding to the hole 30A, so as to form a breaking-off device altogether equivalent to the ones previously described in the aforesaid co-pending application.

The area 24 is further delimited by a folding and partial pre-cutting line 36, with a central folding stretch 36A. Extending beyond said line 36, 36A is a flap 38, which is designed to be glued on the outside of the side 7. Made in this flap 38 is a crescent-shaped tab 40, which develops from the portion of folding line 36A and is delimited in part by an arched slit 42. The side 7 has an arched slit 44, along the folding line 7Y that separates said side 7 from the front 3.

Figure 22:
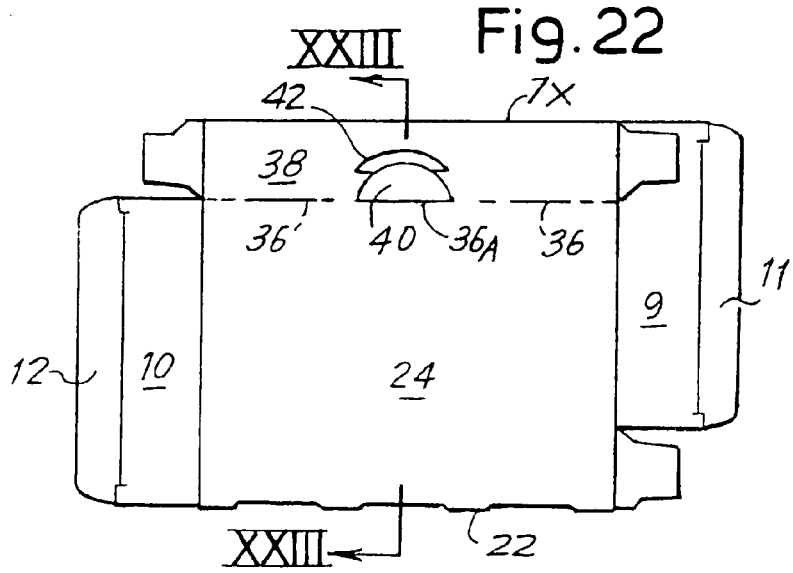

In order to form the box, in the first place the area 28 is turned down about the folding line 26 on the area 24 (FIGS. 20, 21), and the appendage 14 is turned down about the folding line 14X on the front 3. Then—as indicated by the hatched area in FIG. 20—the internal face of the side 5 is moistened with glue, and the ensemble of the parts 7, 3 and 14 is turned down about the folding line 7X (FIGS. 21 and 22). Since the appendage 14 is folded, its external face is glued on the internal face of the side 5. The external face of the side 7 is then further moistened with glue, with the exclusion of the central area thereof (see the hatched area in FIG. 21), and the ensemble 28, 24, 38 is turned down about the folding line 22 against the front 3 and the side 7 to stick the internal face of the flap 38 against the external face of the side 7, with the exclusion of the crescent-shaped tab 40. The pre-cutting and folding line 36, 36A thus faces the folding line 7Y between the side 7 and the front 3.

In this way, there is obtained the flattened box formed by: the front 1; the side 5 coupled to the appendage 14; the front 3, set alongside which is the area 24 with interposition of the area 28 of the strips 30; the side 7 coupled to which is the flap 38 with the tab 40; and the closing flaps 9 and 10. The box can be deformed into the three-dimensional configuration in a conventional way so as to bestow thereon the configuration illustrated in FIGS. 24 and 25.

Figure 24:
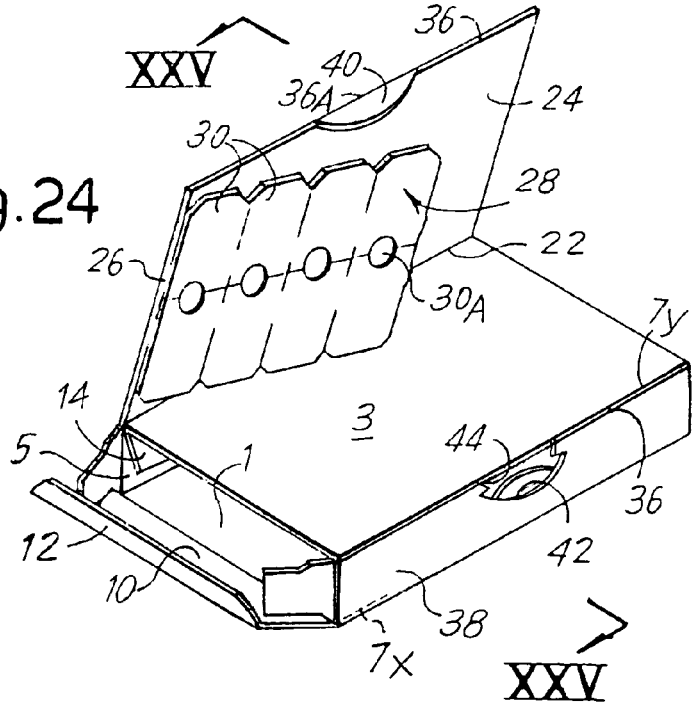
Figure 25:
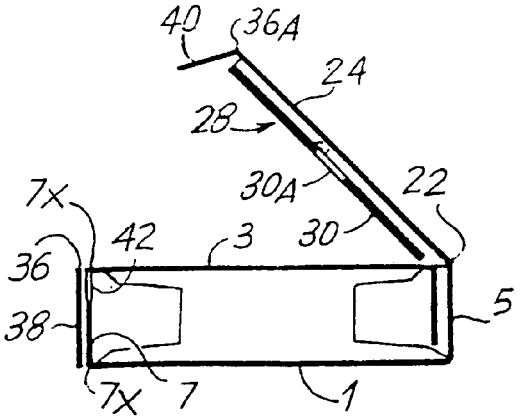

When the box is first used, by lifting up the tab 40, the partial-pre-cutting line 36 breaks so that it is possible to lift the parts 24, 28 with the tab 40 about the folding line 22 (see FIGS. 24 and 25). It is thus convenient to take a strip 30. To re-close the box, the crescent-shaped tab 40 is inserted in the slit 44. The ensemble 24, 28 is lifted whenever is it is desired to take another strip 30, which constitutes the tool for breaking off the neck of a vial.

Traditional paper techniques readily enable mechanized production.

Figure 26:
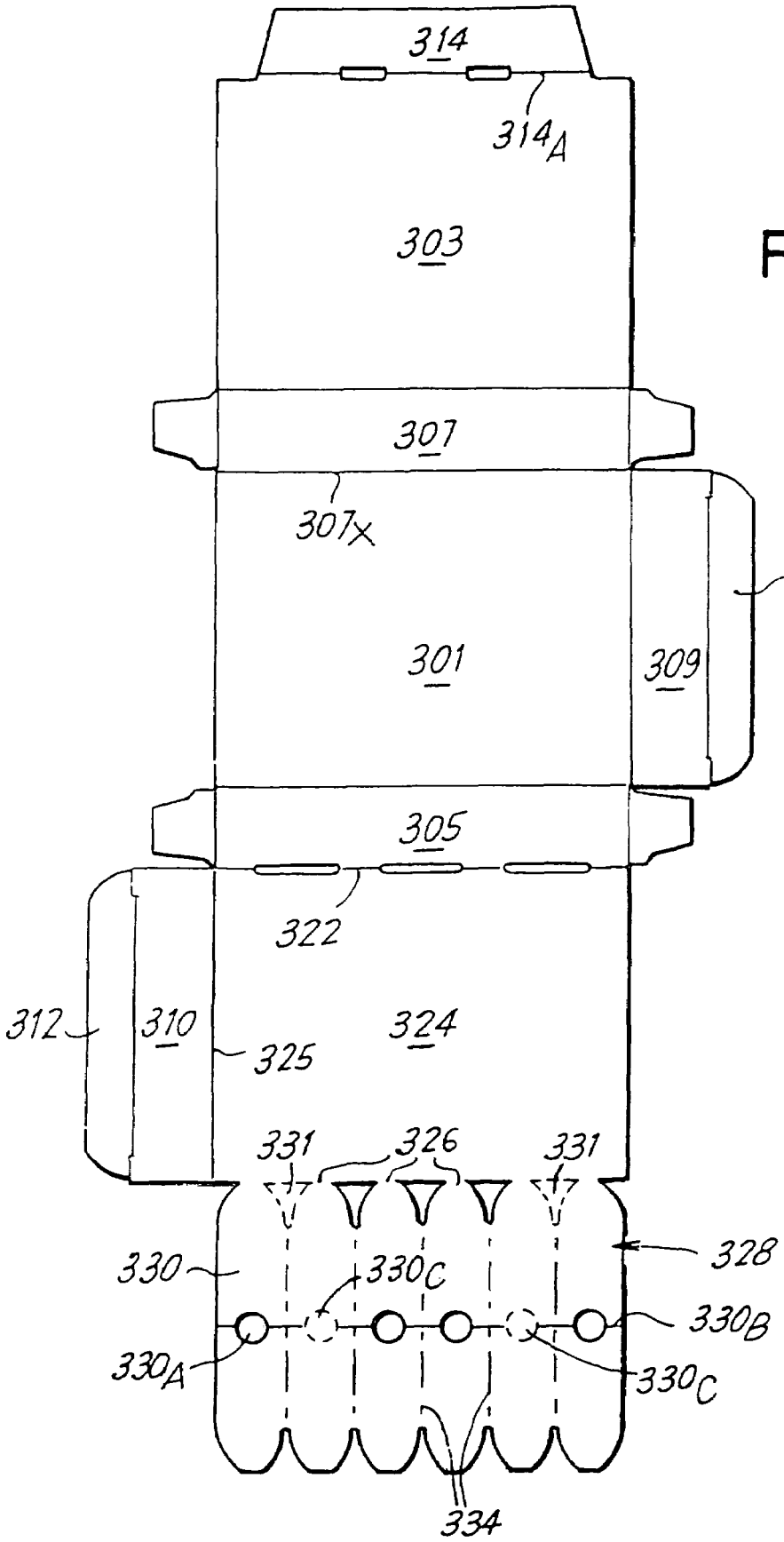

FIGS. 26 to 31 show a solution with a single dinked element, as shown in FIG. 26, which illustrates the internal face of the finished box; this dinked element provides the box and an ensemble of breaking-off tools.

The box is formed by the two fronts 301 and 303 and by the two sides 305 and 307. One closing flap 309 with a closing tab 311 can stem from the front 301 or else from the front 324, whilst the other closing flap 310 with a closing tab 312 stems from an area 324 that is prolonged from a folding line 322 delimiting the side 305. An appendage 314, stemming from the front 303, is glued on the inside of the side 305 to complete the box, access to which for filling can be gained by lifting up one or the other of the closing flaps 309 and 310.

The box thus made is completed by the aforesaid prolongation area 324 forming a lid beyond the folding line 322 that defines the side 305. This prolongation area 324 has a development approximately equivalent to that of the fronts 301 and 303. Said lid area 324 is delimited by a folding line 325, from which there develops the aforesaid closing flap 310, and by a folding and pre-cutting line 326. Developing from this folding and pre-cutting line 326 is an area 328 having a morphology made up of a plurality of strips 330 that can be separated individually so as to function as breaking-off tools with a hole 330A, as described in the aforesaid co-pending application. In greater detail, the area 328 beyond the folding and pre-cutting line 326 has a certain number (six in the drawing) of strips 330, perpendicular to the folding and pre-cutting line 326 and delimited by pre-cutting lines 334 so that progressively a strip 330 can each time be detached, it being possible to separate it along the pre-cutting lines 334. Each of the strips 330 has the hole 330A and a transverse folding line 330B in an area corresponding to the hole 330A so as to form a breaking-off device altogether equivalent to the ones described in the aforesaid co-pending application.

Some of the holes can be defined by circumferential pre-cutting lines only, which delimit disks 330C that can conveniently be detached to complete the hole.

Along the folding and pre-cutting line 326 the strips 330 are shaped to define approximately triangular portions, at least some of which are defined by pre-cutting lines and preserve the material 331, whilst others can be without said material. The line 326 in any case maintains pre-cutting segments, which ensure connection of the strips 330 with the area 324.

In order to form the box, the area 328 is turned down about the folding and pre-cutting line 326 on the lid area 324 (FIGS. 26 and 27), and the triangular materials 331 and/or the disks 330C delimiting some of the holes 330A are glued to the area 324. Furthermore, the appendage 314 is turned down about the folding line 314A on the front 303. Then the internal face of the side 305 is moistened with glue—indicated by the hatched area—and the ensemble of the parts 307, 303 and 314 (the latter folded) is turned down about the folding line 307X so that the external face of the appendage 314 is glued on the internal face of the side 305 (FIGS. 27 and 28).

In this way, there is obtained the flattened box formed by: the front 301; the side 305 coupled to the appendage 314; the front 303, set alongside which is the area 324 with interposition of the area 328 of the strips 330; the side 307; and the two closing flaps 309 and 310. The box can be deformed into the three-dimensional configuration in a conventional way so as to bestow thereon the configuration illustrated in FIG. 31.

At the moment of use, by opening the closing flap 310 it is possible to lift up the ensemble 324 and 328 with the flap 310 about the folding line 322 (see FIG. 31). It is thus convenient to grip and pull away a strip 30, by detaching it from the pre-cutting line 326 and for some strips also from the pre-cutting line of the areas 330C. In order to re-close it, it is sufficient to bring the ensemble 324, 328 back against the front 303 and re-close the flap 310.

Paper manufacturing techniques also in this case conveniently enable mechanization.

Figure 32:
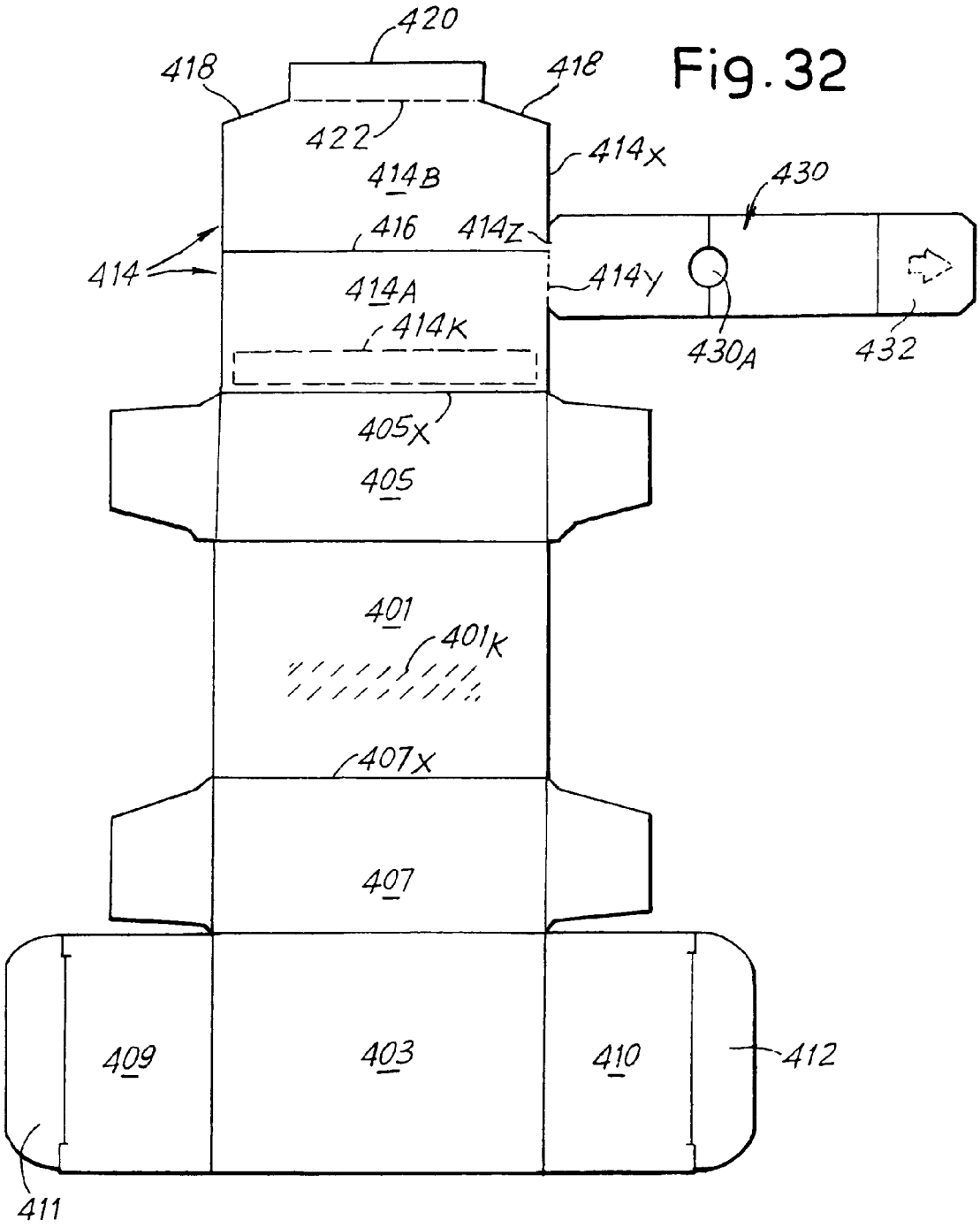
Figure 33:
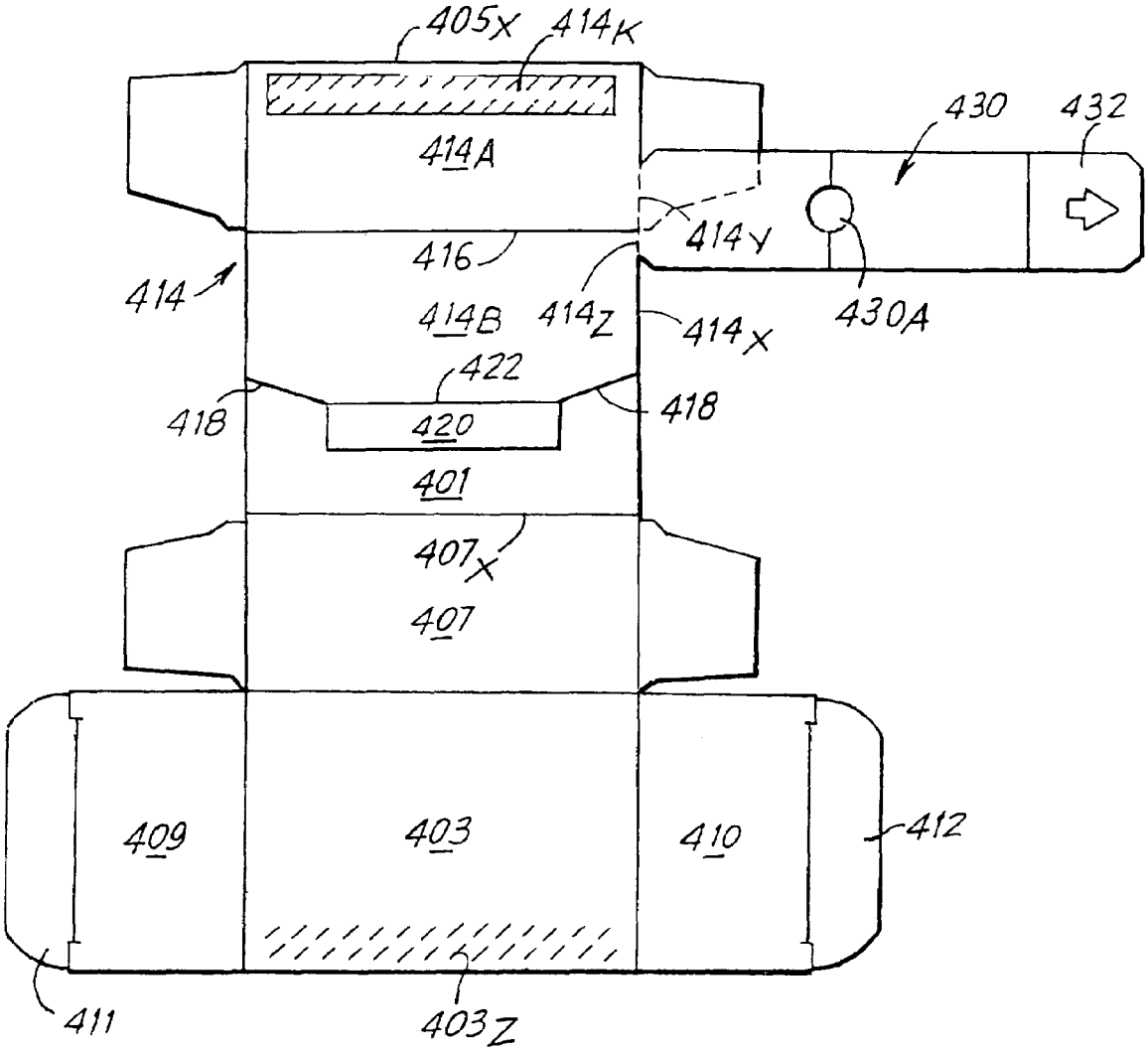
Figure 34:
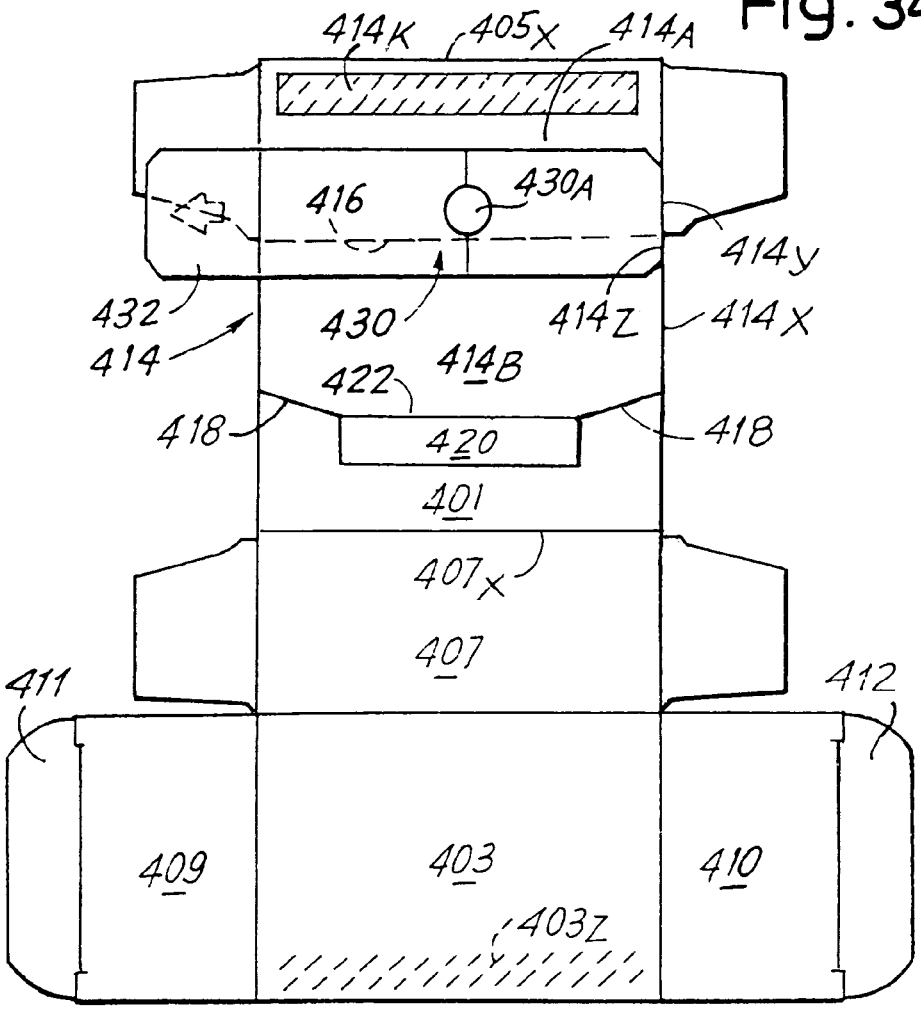
Figure 35:
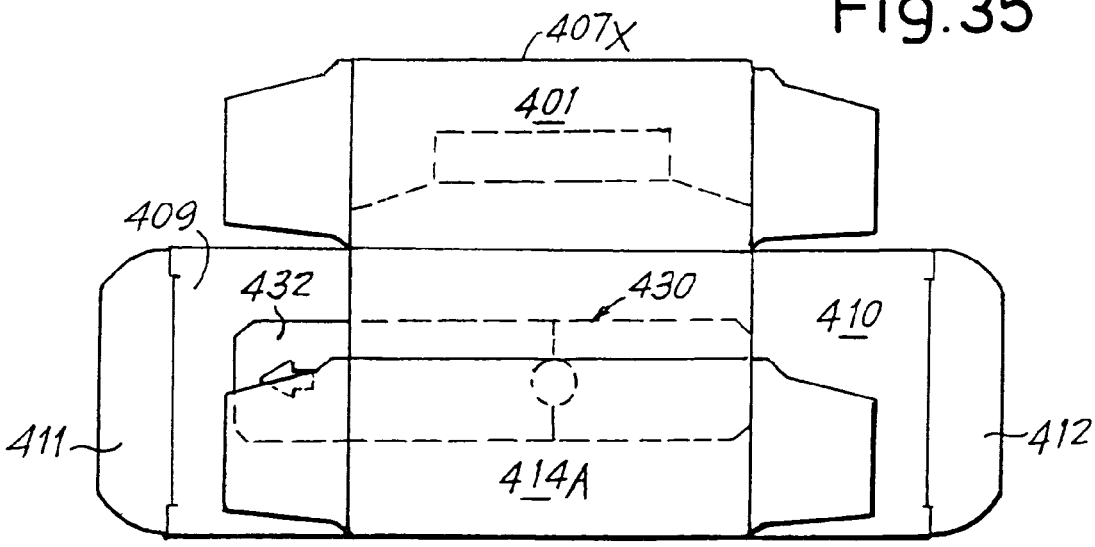

FIGS. 32 to 38 show a solution with a single dinked element, as illustrated from the internal face of the finished box in FIG. 32. This dinked element provides the box divided into two compartments and with a single breaking-off tool. The two compartments are designed to contain a flask and a vial of solvent.

The box is made from the dinked card of FIG. 32, which comprises the two fronts 401 and 403 and the two sides 405 and 407. Two closing flaps 409 and 410 with respective closing tabs 411 and 412 stem from the front 403. From a folding line 405X, which delimits the side 405, there stems an appendage 414, which is divided into two areas 414A and 414B by a folding line 416. The area 414—designed to form a diaphragm—terminates with two chamfered portions 418 inclined and with a tab 420 delimited by a folding line 422. From one of the edges 414X there stems a single transverse strip 430 with the hole 430A and with the terminal tab 432. Said strip 430 constitutes a breaking-off tool for the neck of a glass vial, as defined. Said strip 430 is connected to the edge 414X of the appendage 414 by a folding and pre-cutting line formed by the two stretches 414Y and 414Z; the stretch 414Z is shorter and more weakened than the stretch 414Y.

In order to form the box—the inside of which must be divided into two compartments—the procedure described hereinafter is followed. Along the folding or creasing line 405X (FIG. 33) the components 414 (i.e., 414A and 414B) and 420 are folded by turning down the internal face against that of the side 405 and of part of the front 401, after prior distribution of glue on the tab 420 or on the corresponding area of the front 401. Said tab 420 is thus glued in an intermediate position of the front 401, indicated by the hatched area 401K. Next (FIG. 34), the strip 430 is folded along the folding and pre-cutting line 414Y, 414Z, by being turned down against the external face of the appendage 414 (FIG. 34) in an area corresponding to that of the folding line 416. Then (FIG. 35), the ensemble of the parts 401, 405, 414A, 414B is folded along the folding line 407X between 407 and 401 against the side 407 and the front 403, after prior distribution of glue in the hatched area 414K of the external face of the appendage 414 and/or of the hatched area 403Z. The two surfaces 403Z and 414K (FIG. 35) are then glued to one another.

The box is formed by the two fronts 401 and 403 and by the two sides 407 and 405, and can be closed with the two flaps 409 and 410 and with the two closing tabs 411 and 412. The diaphragm area 414B sets itself as a diaphragm dividing the internal space of the box and has an extension between the two lines 416 and 422 equal to the width of the two sides 405 and 407, if the diaphragm 414B is to be orthogonal to the fronts 401 and 403. If the two compartments separated by the diaphragm are to be the same as one another, the area 414A will have an extension equal to half of the width of the two fronts. The strip 430 is located between the front 403 and the area 414A. The tabs 411 and 412 set themselves in place—during closing—thanks to the chamfered portions 418.

When the box is arranged in the three-dimensional configuration (FIGS. 36 to 38), the stretch 414Z is cut off, and the strip 430 remains comprised between the front 403 and the area 414A.

When the box is used (FIG. 38), by opening the flap 409 it is possible to grip the tab 432 and detach the strip 430 along the pre-cutting line 414Y in order to be able to use the strip for cutting off the neck of the vial contained in the box.

When the container must be introduced into one of the two compartments of the box, this assumes the configuration represented in FIG. 38 with the strip 430 and the tab 432 that do not hamper insertion of the vial and of the flask.

It is understood that the drawing shows just one a simplified example, which is provided merely by way of practical demonstration of the invention, it being possible for said invention to vary in its shapes and arrangements without however departing from the scope of the concept underlying the invention itself. Any possible presence of reference numbers in the attached claims has the purpose of facilitating reading of the claims with reference to the description and to the drawings and does not limit the sphere of protection represented by the claims.

What I claim is:

1. A box for a glass vial with a neck to be broken off, the box comprising:

a dinked card defining a box with an appendage, said appendage having a plurality of strips, each strip having a defined central hole for insertion of a neck of a glass vial, each strip being detachable from said appendage, said appendage being detachable at a location within said box, said box having a first front portion and a second front portion, said dinked card having a prolonged portion extending from an edge of said first front portion, said prolonged portion being folded such that said first front portion holds said prolonged portion in position, said prolonged portion having a prolonged area, wherein a closing tab extends from said prolonged portion, said closing flap holding said prolonged portion against one of said first front portion and said second front portion when said closing flap closes an opening defined by said box.

2. The box as in accordance with claim 1, wherein undetached strips of said plurality of strips are located within the box after at least one of said strips has been detached from said appendage.

3. The box in accordance with claim 2, wherein said appendage is housed in the box.

4. The box in accordance with claim 2, wherein said box has a front portion and another front portion, said appendage being located in a seat formed by one of the front portions and a flap portion that engages one side of the box.

5. The box in accordance with claim 4, wherein said appendage extends from said flap portion, said appendage being detachable from said flap portion.

6. The box in accordance with claim 1, wherein said appendage is connected to the box by a folding and precutting line that is partialized by cut areas, for facilitating detachment.

7. The box in accordance with claim 1, wherein said box has a first front portion and a second front portion, said appendage being connected to the box by a bridge portion connected to said first front portion, said bridge portion being detachable from said first front portion such that said appendage is detached from said box.

8. The box in accordance with claim 1, wherein said prolonged portion of the dinked card has a tab, said tab being folded such that said tab holds said prolonged portion against said first front portion.

9. A structure for a glass vial with a neck to be broken off, the structure comprising:

a dinked material with predefined edges providing a prefolded shape, said dinked material being folded such that said folded material defines a box-shaped structure having an appendage element attached thereto along a first perforated line, said appendage element having a plurality of strip pieces, one strip piece being adjacent another strip piece along a second perforated line, each strip piece defining a central hole for receiving a portion of a glass vial, each strip piece being detachably connected to said appendage element along said second perforated line such that said each strip piece is detached from said appendage element along said second perforated line after said appendage element has been detached from said box along said first perforated line.

10. The box in accordance with claim 9, wherein said box-shaped structure has a front portion and another front portion, said appendage element being located in a seat formed by one of the front portions and a flap portion that engages one side of the box-shaped structure.

11. The box in accordance with claim 10, wherein said appendage element extends from said flap portion, said appendage element being detachable from said flap portion.

12. The box in accordance with claim 9, wherein said box-shaped structure has a first front portion and a second front portion, said appendage element being connected to the box-shaped structure via a bridge portion connected to said first front portion, said bridge portion being detachable from said first front portion such that said appendage element is detached from said box-shaped structure.

13. A structure for a glass vial with a neck to be broken off, the structure comprising:

a dinked blank formed of an integral piece of material with predefined edges and predefined fold lines providing a prefolded shape, said blank being folded along said predefined fold lines such that said blank forms a box-shaped structure with an appendage element having a plurality of glass vial removal elements located therein, said appendage element being detachably connected to said box-shaped structure along a first perforated portion of said box-shaped structure, one glass vial removal element being adjacent another glass vial removal element along a second perforated line, each glass vial removal element having a defined center hole for receiving a portion of a glass vial, said appendage element being detached from said box-shaped structure such that each glass vial removal element is located at a position outside of said box-shaped structure, one glass vial removal element being detached from another glass vial removal element when said appendage element is located at a position outside of said box-shaped structure.

14. The box in accordance with claim 13, wherein said box-shaped structure has a front portion and another front portion, said appendage element being located in a seat formed by one of the front portions and a flap portion engaging one side of the box-shaped structure.

15. The box in accordance with claim 14, wherein said appendage element extends from said flap portion, said appendage element being detachable from said flap portion.

16. The box in accordance with claim 13, wherein said box-shaped structure has a first front portion and a second front portion, said appendage element being connected to the box-shaped structure via a bridge portion connected to said first front portion, said bridge portion being detachably connected to said first front portion such that said appendage element is detached from said box-shaped structure when said bridge portion is detached from said first front portion.

* * * * *